US012102865B2

(12) United States Patent
Betts et al.

(10) Patent No.: US 12,102,865 B2
(45) Date of Patent: Oct. 1, 2024

(54) SPORTS TRAINING AND PHYSIOTHERAPY GARMENTS

(71) Applicant: Nudge Group Limited, Brentford (GB)

(72) Inventors: Anthony Betts, London (GB); Felix Weaver, Brentford (GB)

(73) Assignee: Nudge Group LTD, Brentford (GB)

( * ) Notice: Subject to any disclaimer, the term of this patent is extended or adjusted under 35 U.S.C. 154(b) by 474 days.

(21) Appl. No.: 17/299,766

(22) PCT Filed: Dec. 4, 2019

(86) PCT No.: PCT/EP2019/083656
§ 371 (c)(1),
(2) Date: Jun. 3, 2021

(87) PCT Pub. No.: WO2020/115122
PCT Pub. Date: Jun. 11, 2020

(65) Prior Publication Data

US 2022/0047004 A1 Feb. 17, 2022

(30) Foreign Application Priority Data

Dec. 5, 2018 (GB) ..... 1819862

(51) Int. Cl.
*A63B 21/065* (2006.01)
*A41D 13/00* (2006.01)
(Continued)

(52) U.S. Cl.
CPC ..... *A63B 21/065* (2013.01); *A41D 13/0015* (2013.01); *A41D 31/185* (2019.02);
(Continued)

(58) Field of Classification Search
CPC ..... A41D 13/0015; A41D 31/185; A63B 21/0552; A63B 21/4009; A63B 21/4025; A63B 21/4039; A63B 21/065
(Continued)

(56) References Cited

U.S. PATENT DOCUMENTS 807,908 A 12/1905 Bradstreet
5,010,596 A * 4/1991 Brown ..... A63B 21/065 2/238
(Continued)

FOREIGN PATENT DOCUMENTS

EP 2813154 A1 12/2014
GB 2461072 A * 12/2009 ..... A41D 13/0015
(Continued)

OTHER PUBLICATIONS

Office Action, China Patent Application No. 201980091408.5, Jul. 29, 2022, 7 pages.
(Continued)

*Primary Examiner* — Jocelyn Bravo
(74) *Attorney, Agent, or Firm* — IPTechLaw

(57) ABSTRACT

A posture and movement training garment 100 comprises at least one elastic element arranged to be stretched upon movement of the wearer's trunk and/or at least one of the wearer's limbs away from a predetermined rest or neutral position, thereby to provide the wearer with gentle elastic recoil sufficient to provide the wearer with additional kinaesthetic and/or touch feedback resulting from the movement, substantially without inhibiting the movement. A complementary sports training or physiotherapy garment comprises a fabric base and pockets for the reception of weights, the garment further comprising strips of relatively inextensible material forming a network interconnecting the base material within the pockets, in which the majority of
(Continued)

the strips run generally longitudinally of the wearer's limbs and torso and form a branched network with bases mainly originating at the wearer's shoulders and/or hips; and wherein the network does not completely encircle the wearer's limbs and torso.

20 Claims, 15 Drawing Sheets

(51) Int. Cl.
*A41D 31/18* (2019.01)
*A63B 21/00* (2006.01)
*A63B 21/055* (2006.01)

(52) U.S. Cl.
CPC ..... *A63B 21/0552* (2013.01); *A63B 21/4009* (2015.10); *A63B 21/4025* (2015.10); *A63B 21/4039* (2015.10)

(58) Field of Classification Search
USPC ..... 482/105
See application file for complete search history.

(56) References Cited

U.S. PATENT DOCUMENTS 5,144,694 A * 9/1992 Conrad Da oud ... A63B 21/065 D2/737
5,553,322 A 9/1996 Cebo-Johnson
5,555,562 A 9/1996 Holt et al.
5,606,745 A 3/1997 Gray
5,819,322 A * 10/1998 Dicker ..... A42B 3/0493 2/456
5,857,947 A * 1/1999 Dicker ..... A63B 21/00185 482/122
5,937,441 A 8/1999 Raines
6,047,405 A 4/2000 Wilkinson
8,156,572 B2 4/2012 Whaley
8,533,864 B1 * 9/2013 Kostrzewski ..... A41D 13/0015 2/69
D703,919 S 5/2014 Whaley
8,832,863 B2 9/2014 Yang
9,144,252 B1 * 9/2015 Kostrzewski ..... A41D 1/08
9,301,554 B2 * 4/2016 Whaley ..... A41D 1/00
9,895,569 B2 * 2/2018 Yao ..... A63B 21/4005
10,039,330 B2 * 8/2018 Tanaka ..... A41D 1/088
10,842,204 B2 * 11/2020 Stricker ..... A41D 31/185
2002/0010058 A1 1/2002 Myrick
2003/0092544 A1 * 5/2003 Reed ..... A63B 21/4025 482/105
2005/0014126 A1 1/2005 Segermark et al.
2009/0139005 A1 * 6/2009 Whaley ..... A63B 21/0602 2/243.1
2010/0256717 A1 10/2010 Brown
2012/0144549 A1 * 6/2012 Caillibotte ..... A63B 21/4009 2/69
2012/0174282 A1 * 7/2012 Newton ..... A41D 31/185 2/69
2013/0212767 A1 * 8/2013 Nordstom ..... A41D 31/185 2/69
2013/0326785 A1 * 12/2013 Cornacchiari ..... A41D 1/00 2/69
2014/0200118 A1 * 7/2014 Lathen ..... A63B 21/4009 482/105
2014/0302970 A1 * 10/2014 Sinclair ..... A63B 21/0601 482/105
2015/0306441 A1 * 10/2015 Yao ..... A63B 21/4019 482/124
2017/0065843 A1 3/2017 Foster
2017/0304670 A1 10/2017 Herron

FOREIGN PATENT DOCUMENTS

GB 2462477 A 10/2010
GB 2491817 A 12/2012
KR 100989828 B1 10/2010
KR 100989829 B1 10/2010
KR 101200852 B1 11/2012
KR 101503422 B1 3/2015
WO 2017218765 A1 12/2017
WO 2018075757 A1 4/2018
WO 2018083468 A1 5/2018

OTHER PUBLICATIONS

International Search Report, PCT Patent Application No. PCT/EP2019/083656, Jun. 24, 2020, 5 pages.

* cited by examiner

SPORTS TRAINING AND PHYSIOTHERAPY GARMENTS

This invention relates to garments for use in sports training, physiotherapy or in other fields and applications, to train the wearer to adopt a good posture and encourage healthy movements of the limbs and body. Injuries resulting from mechanically overstressing muscles, joints and tendons, as well as more chronic musculoskeletal disorders, may thereby be mitigated or avoided. The invention also relates to similar sports training or physiotherapy garments and their components, used to tone and exercise the muscles, and promote muscle, bone and/or joint strength.

A known form of garment which aims to optimise human posture and motion consists of a close-fitting, full or partial, body suit of stretchable fabric, reinforced in strategic areas by bands or panels of elastic material. These bands or panels are positioned and aligned relative to associated muscles and joints, so as to resist movements at the joint away from an optimum rest position. This encourages the user to learn to adopt that position as their normal resting position, as well as acting to strengthen and tone the muscles, Examples of such garments are shown in EP2813154A1 and U.S. Pat. No. 9,895,569B2, While such elastic reinforcing bands or panels may be effective in encouraging a good resting posture, their known implementations are less effective in encouraging healthy body movements, or particular body movements which are more efficient for performing associated activities; whether in sport, daily life, or in other contexts, such as at work or in the fields of occupational health, physiotherapy and orthopaedics. The known elastic reinforcing bands and panels are arranged to resist displacement of the associated joint away from a particular resting position, with greater displacements tending to produce higher resistance forces to the movement. However these known arrangements do not provide adequate guidance of the direction of rotational motion at the joints (or stabilization of a joint or joints) at particular relative rotational positions. To strengthen the muscles, the elastic resistance becomes substantial at high extensions. Further movement of the joint concerned may therefore be inhibited. These arrangements of elastic reinforcing bands therefore do not provide adequate dynamic guidance for the mechanism of the muscles, bones and joints, necessary to train healthy movement and/or more efficient motion in carrying out particular physical tasks.

Another known form of garment is fitted with weights (masses) which are subject to gravitational force and which also provide accelerational/decelerational forces, to increase the load on the wearer's muscles, joints and bones, or on particular joints, muscles or muscle groups in use. The weights may be removable or replaceable with weights of differing mass, e.g. so as to vary the imposed loads to suit the physique or fitness level of the user, and/or to work on particular muscles or muscle groups etc. The removable weights are typically housed in openable/securely recloseable pockets permanently attached to the garment. Or they may be in the form of packets or packages removably fastenable to the garment by hook-and-loop type fastening patches, poppers, buttons or the like. Yet alternatively, the weights may be permanently secured to or within the garment.

To make the garment comfortable to wear and to avoid interference and distraction during physical activity, measures may be taken to minimise relative movement between the weights and the part of the use's body which they overlie. For example, the garment may be close-fitting and formed from a suitable elastic material such as Lycra (RTM) or Spandex (RIM). Thus the garment may be sized to stretch when worn, to at least lightly compress parts of the wearer's body that it covers. The garment or the material that it is made from may include substantially inextensible material or threads or fibres, which connect to or interconnect the weight pockets or weight attachment locations, so as to distribute the corresponding forces in the stretchable fabric of the garment, and/or to prevent the weights from sagging under gravity or moving under dynamic loads. For example, the inextensible components may form a harness-like structure by which the weights are suspended from suitable parts of the wearer's body; for example forming a belt-like structure about the wearer's waist, and/or a halter-like structure about the wearer's neck and/or shoulders. The substantially inextensible harness-like structure about the wearer's torso may be connected to one or more extensions running the length of one or more of the wearer's limbs, to provide centripetal acceleration forces during curved motion of any weights attached to that limb. Axial shifting of the weights and gravitational and centripetal loading of the limb joints are thereby resisted. Shifting of the weights circumferentially about, or radially away from, the wearer's limbs or torso, may be resisted by the pressure of the stretched garment fabric against the wearer's body.

The weights themselves are placed in locations where they will not obstruct movement of the wearer, e.g. away from the wearer's joints. For example they may be located over the muscles and/or connective tissues that they are intended to load. Alternatively, they may reside on a segment of the body which requires muscles for its movement which are local but not directly adjacent, such as the bicep/tricep contracting in order to move the forearm. The weights may be formed from suitable dense flowable materials such as water or sand in a flexible container or pouch. This makes the weights comfortable to wear, as they mould themselves to the wearer's body. However as the weight material is mobile, it can move about in its container during exercise, possibly distracting the garment wearer or throwing the intended movement out of balance.

Alternatively, the weights may be formed from suitable dense solid materials, such as metal. This kind of weight is less comfortable to wear, and might even cause injury to the wearer during vigorous exercise. To address this problem, the solid weights may be subdivided into small separate parts, each inserted or sewn into its own articulated textile compartment, often together with a wrapper or padding, to form a flexible weight package or assembly. These measures however decrease the overall density and hence increase the bulk of the weights, sometimes to the point where they can interfere with movement of the wearer and also possibly spoiling the aesthetic appeal of the garment. Alternatively, the weights may be formed from suitable flexible solid materials, such as silicone elastomers and/or gels. Such weights are in general comfortable to wear but are however of quite low density. This again can lead to undesirably bulky weights.

US6047405, U.S. Pat. No. 5,555,562, GB2462477A, WO2017/218765A1, U.S. Pat. No. 5,144,694, US2002/0010058A1, US2017/0304670A1, U55553322 and US8156572B2 provide an indication of the technological background in this area. WO2018/075757 discloses articles of apparel, including an integrated fabric system comprising strategically-placed weighting and/or elastic resistance elements formed from an elastomer such as medical grade silicone, rubber and/or one or more gel substances. The resistance elements may be impregnated with a relatively heavy (dense) material, which may be in the form of particles or powdered elements. It appears that the heavy material must be in atomic, molecular or finely divided particulate form, because it must be impregnated (together with the uncured elastomer matrix-forming material) into the base textile fabric from which the apparel is formed. US807908 discloses an improved harness constructed of straps of elastic webbing, adjustable to fit different human body sizes. The harness is presented as an improvement of the general class of exercising devices which exert strain or resistance on the human body in opposition to the movements of the various body members, Though it is mentioned that no special exercise regime is needed other than normal daily activities, and that the opposition to movement may be slight, the objective is still to develop the wearer's muscles by resistance training, rather than simply to provide enhanced feedback of body part movement and positioning, U.S. Pat. No. 5,606,745A also concerns a resistance exercise suit, i.e. again to provide muscle development, rather than movement feedback. The resistance members are provided in elongate pockets in the suit, and appear to resist bending rather than resisting elongation.

The present invention aims to address at east some of the problems mentioned above.

Accordingly, in a first independent aspect, the present invention provides a posture and movement training garment (hereafter "posture garment"), comprising at least one elastic element arranged to be stretched upon movement of the wearer's trunk and/or at least one of the wearer's limbs away from a predetermined rest or neutral position, thereby to provide the wearer with gentle elastic recoil sufficient to provide the wearer with additional kinaesthetic and/or touch feedback resulting from the movement, substantially without inhibiting the movement. Such feedback-generating elastic elements provide tension whose recoil reacts on the limbs and/or trunk in a direction tending to pull them towards a default (for example symmetrical) posture or stance, after any movement of the body and/or one or more of the limbs away from that default position. The tension or reactive recoil of the elastic element is perceived by the body/brain so as to provide a powerful directional and positional feedback regarding the corresponding movement. The wearer's learned body representation (learned spatial map of the parts of the body, their current positions and possible movements, derived from messages from the muscles, ligaments and joints) is thereby enhanced. The user may then more easily activate their muscles to correct their body's position or posture, and/or to follow a movement pattern which is closer to the optimum for a particular physical activity.

For example, there may be minimal tension and elastic recoil provided by the elastic element when the wearer is in a healthy upright posture. As the user's body moves within the posture garment, the elastic element(s) generate a recoil to direct or guide the body gently back towards the default healthy posture. The elastic element(s) allow(s) for natural movement but help to keep good body form and posture, e.g, for a healthy and balanced upright stance, and/or for particular physical activities, and or to prevent uncontrolled motion around the limbs or trunk.

The material elastic constant of the elastic elements may be less than or equal to 3600 N/m, optionally less than or equal to 2400 N/m. A material elastic constant of less than or equal to 360 $N \cdot m^{-1}$ for the elastic element(s) can serve to provide most wearers of the posture garment with kinaesthetic or touch feedback while not overly inhibiting the user's natural body movements. Higher material elastic constants may be used, e.g. up to 500 $N \cdot m^{-1}$ in the case of particular individuals, or classes of individual, having a higher strength and/or stamina; e.g. the very fit and strong, or elite athletes and sportspeople.

To provide adequately perceptible kinaesthetic or touch feedback to most users (e.g. to be distinguishable from the light tension and compression provided by a stretchable base layer of the posture garment onto or into which the elastic element(s) may be applied or incorporated), the material elastic constant of the elastic element(s) may be at least 90 $N \cdot m^{-1}$ It may be higher in some cases, e.g. 150 $N \cdot m^{-1}$ or more, e.g. around 190 $N \cdot m^{-1}$ where the posture garment is to be worn together with thick or heavy (and therefore somewhat movement inhibiting) protective padding or clothing; or to be worn together with a resistive training garment, such as the weighted garments described elsewhere in this specification. The material elastic constant of the elastic elements may be 600 N/m or greater, optionally 1000 N/m or greater. Different ones of the elastic elements may have different material elastic constants and/or lengths, e.g. providing recoil adapted to the pulling power and the range of movement of the corresponding muscle/joint/bone mechanisms in the wearer. For example the different elastic elements may be made from different materials. Additionally or alternatively, the different elastic elements may have different lengths and/or widths and/or number of layer(s) of material, which again may provide recoil adapted to the pulling power and the range of movement of the corresponding muscle/joint/bone mechanism in the wearer. The stress-strain behaviour of some or all the elastic elements may be non-linear, and/or rate dependent, e.g. viscoelastic.

The presence and use of the above-described elastic elements in the posture garment does not preclude the presence and use of other elements (whether elastic or substantially inelastic) in, of or attached to the posture garment, which do serve to substantially resist, restrict or inhibit particular movements of the user's trunk and/or limbs.

The posture and movement training garment may be used encourage neuromuscular activation in under-active muscles and neuromuscular inhibition in overactive muscles by providing the required positional feedback to enhance the wearer's awareness of regions of the body where muscles are overextending and regions where muscles are underextending. The posture and training garment may provide neuromuscular activation and neuromuscular inhibition in both kinetic sequences and stationary positions through targeted elastic tension lines, which act moderately against the user from many angles even in a neutral upright and symmetrical posture setting and increase proportionately against a body segment whose posture and/or movement is to be trained, as it deviates away in any direction from the neutral setting.

The posture and training garment may provide a matrix of the elastic elements which converge at regions which have no specific anchoring points, mimicking the architecture of human fascial lines which do not end abruptly but instead link together and converge in particular regions of the body.

The neuromuscular effects of the posture and training garment may be complemented by loading the body with additional mass, with the mass providing increased resistance to muscle contraction (as well as optionally simulating added muscle mass) and the posture and training garment assisting the body in maintaining optimal and correct positioning through its elastic matrix which encourages adoption of symmetrical and neutral upright positions. The posture and training garment trains and promotes chronic/long term adaptations that relate to speed, acceleration, deceleration, vertical jump height and potentiation of the nervous system in human trials by providing elastic forces which help to correctly and efficiently position the user even during high velocity and dynamic movement patterns, who may then be loaded with added mass, having created specific adaptions to increased physical demands.

The recoil of the elastic elements may provide the wearer with enhanced guidance for relative movement of different portions of the trunk or torso, for example of the shoulder girdle, thorax, abdomen, spine, core, and pelvic girdle/sacrum, and/or of points or positions in between these, such as the sternum, mid-back, mid-point between the anterior pelvic ridge and the umbilicus.

The recoil of the elastic elements may additionally or alternatively provide the wearer with enhanced guidance of movement of the head and/or limbs relative to the trunk, and/or between different portions of the limbs. For example, enhanced guidance of relative movement of the shoulder girdle and a point along (e.g. approximately half-way along) the length of the humerus; between a point along the humerus (e.g. as above) and a point along (e.g. approximately half-way along) the forearm; between the pelvic girdle and a point along (e.g. approximately half-way along) the thigh bone; and/or between a point along the thigh bone (e.g. as above) and a point along (e.g. approximately half-way along) the shin. The additional kinaesthetic and/or touch feedback may be provided for one, two or three orthogonal planes of rotation or degrees of rotational freedom of the movement. For example, relative rotational motion of the different parts of the trunk (shoulder girdle, pelvic girdle, etc.) may be guided in the sagittal, frontal and/or transverse planes. Enhanced movement feedback and guidance for the core muscles and joints may be provided to the wearer by specific elongate elastic elements arranged in the posture garment over the wearer's abdominal muscles and posterior spine.

The elastic elements associated with the wearer's trunk may be connected to elastic elements providing enhanced guidance of the limbs. For example elastic elements in the legs of the posture garment may be coupled to elastic elements in the pelvic or core region of the posture garment. Similarly, elastic elements in the arms of the posture garment may be coupled to elastic elements in the shoulder girdle of the posture garment.

Each leg of the posture garment may be provided with an attached (e.g. integrally formed or permanently attached) foot part or strap passing beneath the arch of the wearer's foot, to prevent the garment from riding up the wearer's legs during arm and trunk movements. Similarly the arms of the posture garment may be provided with an attached (e.g. integrally formed or permanently attached) full or partial glove or strap passing between the wearer's fingers and/or fingers and thumb, to prevent the garment from riding up the wearer's arms during movement.

All of these elastic elements may be assembled or constituted in any suitable way, e.g. each being separately fabricated from a single piece of suitable elastic material, for example elongate strips or bands. As another alternative, fabric pieces used to make the posture garment and which are cut to a pattern may each contain at least parts of different ones of the elastic elements, so that one or more or all of the elastic elements are assembled from a plurality of different fabric pieces. The posture garment may comprise a base layer or layers of suitable fabric, e.g. a breathable and moisture wicking fabric comprising stretchable yarn comprising resiliently stretchable fibres such as Lycra (RTM) (elastane), to which the elastic elements are attached by any suitable means, such as by heat bonding or by stitching. The base layer material may be more easily stretchable than the material from which the elastic elements are formed.

In a second independent aspect, the present invention provides a weight for use in a sports training or physiotherapy garment (hereafter "weighted garment"), the weight comprising a body formed from an elastomer, in which the body contains an embedded plurality of pieces of a harder, denser material, each piece having a minimum dimension of at least 1.5 mm (e.g. 2, 2.5, 3, 3.5, 4, 4.5 or 5 mm) and in which the individual pieces are movable relative to one another, whereby the body retains its flexibility. The harder, denser material pieces increase the overall density of the body and thereby reduce the bulk of a weight having a given mass. The weight, when attached to the weighted garment, is therefore less apt to obstruct movements of the garment wearer. The number and/or size of the individual embedded pieces of the harder and denser material may be selected so as to adapt the mass of the weight to the wearer's individual training or physiotherapeutic needs. The individual embedded pieces are also of sufficient size to be felt with the fingers, through the elastomer. A user of the weighted garment, and/or their physiotherapist, sports coach, personal trainer etc., therefore can easily tell by touch the extent to which the body is loaded with the harder and denser material, and hence gain a more precise indication of the overall mass and density of the body than is obtainable by simply weighing it in their hand. At the same time, the overall flexibility of the body is substantially unaffected by the presence of the harder, denser material; so that the weighted garment is comfortable to wear and the weights themselves present a low risk of injury to the wearer during exercise.

The elastomer may be translucent or transparent, so that the embedded pieces are visible within it; the minimum size of the pieces assisting them to be seen individually by the unaided eye.

The elastomer may comprise a silicone rubber.

Some or all of the embedded pieces may be linked together in an articulated way, e.g. forming links in an embedded chain or links in embedded chainmail. Alternatively some or all of the embedded pieces may be unconnected with each other, apart from by virtue of being embedded in the elastomer. This may make them easier to feel and/or see individually.

The embedded pieces may be arranged in a single layer or in a low number of layers (e.g. two, three or four), so that the overall thickness of the body of the weight may be kept small. The thickness dimension of the body of the weight may be substantially less than the two other orthogonal dimensions (the length and breadth of the body of the weight). The thickness profile of the weight may therefore be kept low. For example, the weight may be generally flat when not flexed.

The embedded pieces may be substantially spherical, e.g. formed by ball bearings. The embedded pieces may be formed from any suitable high density material; e.g. metals including iron, steel, stainless steel, lead, gold, tungsten, mercury (in a suitable container) and depleted uranium; alloys or mixtures of such metals; or ceramics such as silica or alumina; or concrete or natural or artificial stone, or assemblies or mixtures of any of these materials.

The weight may comprise a member of a set of weights. The set may comprise weights of various different predetermined shapes, each respectively adapted for use in a different predetermined position on the wearers' body; e.g. associated with a different muscle, muscle group, joint, bone, piece of connective tissue, or other feature of the musculoskeletal anatomy. A different one or combination of the differently shaped weights may be used together in association with each particular musculoskeletal anatomical feature respectively. This may reduce the number of differently shaped weights required; improving economy and ease of manufacture and use.

The set of weights may comprise different predetermined masses each respectively adapted for use at one or more of the predetermined positions; and/or different predetermined masses used to match the mass at a given predetermined position to the wearer's particular needs.

The maximum dimension of the embedded pieces in the possible range of differently sized embedded pieces used to tailor the mass of a given weight in the set may be 30 mm or less; for example 29, 28, 27, 26, 25, 24, 23, 22, 21, 20, 19, 18, 17, 16, 15, 14, 13, 12, 11, 10, 9, 8, 7, or 6 mm; or at 0.5 or 0.25 mm increments above or below any of these dimensions. For example the embedded pieces may be ball bearings of 9.5 mm diameter, or ball bearings of any of the other diameters mentioned above. This again keeps the thickness profile of the weights low.

The number of embedded pieces in a given weight of the set (e.g. for use in a particular position in the weighted garment) may be kept the same when tailoring the weight to provide a different mass. This allows the weights in the set to be readily ranked in order of mass by feeling or viewing the size of the embedded pieces.

Alternatively, the size of the embedded pieces in a given weight of the set may be kept the same when tailoring the weight to provide a different mass. This allows the weights of the set to be readily ranked in order of mass by feeling or viewing the spacing between the embedded pieces.

The invention also extends to weighted garments comprising weights or sets of weights as described above.

In yet another aspect, the invention provides a sports training or physiotherapy garment comprising a fabric base and pockets for the reception of weights, the garment further comprising strips of relatively inextensible material forming a network interconnecting the base material within the pockets, in which the majority of the strips run generally longitudinally of the wearer's limbs and torso and form a branched network with bases mainly originating at the wearer's shoulders and/or hips; and wherein the network does not completely encircle the wearer's limbs and torso. The weight pockets may nevertheless be positioned all around the wearer's body, e.g. to the front, back, and/or sides.

The networks of the relatively inextensible strips may be provided (i) in legs of the garment, transmitting weight forces to the wearer's pelvis, and (ii) in the remainder of the garment transmitting weight forces to the wearer's shoulder girdle.

When the networks (i) and (ii) are not interconnected by any of the relatively inextensible strips, the garment may be provided either in a one piece configuration, or in a two piece configuration comprising a separate jacket and trousers.

When the networks (i) and (ii) are interconnected, the lower body and leg weights are provided with additional support.

Both the fabric base and the network of strips of relatively inextensible material may be formed from panels of textile fabric material cut to a pattern and joined together by seams.

A strip of the relatively inextensible material may be provided in a shoulder region of the garment, this strip having a higher elasticity than the strips forming the remainder of the network.

The invention and some of its advantages and optional features may be further understood from the following description of illustrative embodiments, made with reference to the drawings, in which:

FIG. 1 is a schematic front view of a first embodiment of a posture garment of the present invention;

FIG. 1*a* shows a modification to the sleeves shown in FIG. 1;

FIGS. 2 and 3 are schematic back and side views generally corresponding to FIG. 1; one leg being shown in a partly raised position in FIG. 3;

FIGS. 2*a* and 3*a* are views corresponding to FIGS. 2 and 3, showing the modified sleeve of FIG. 1*a;*

FIG. 3*b* shows a further modification of part of the garment shown in FIG. 3;

Figure 13:
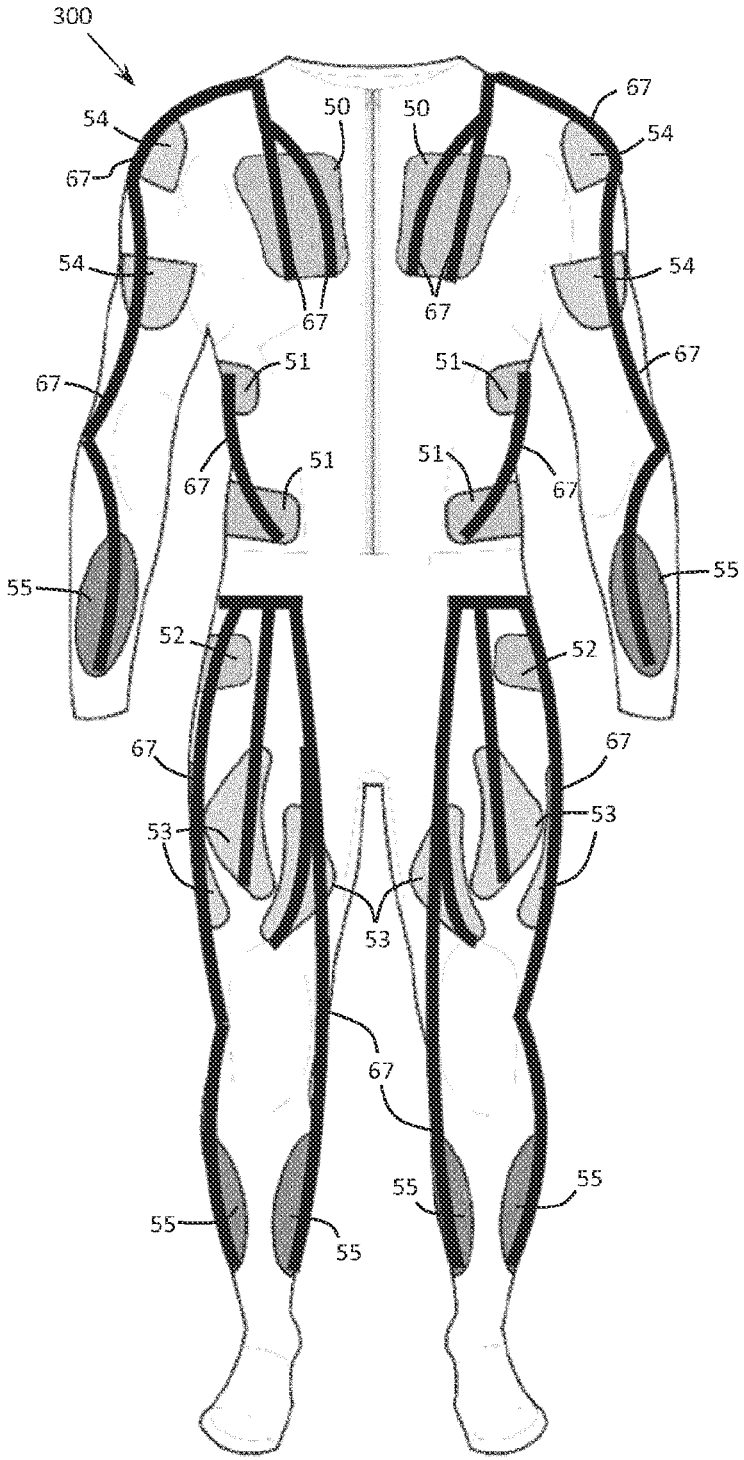
FIGS. 13 and 14 are respectively front and back views of the weighted garment of FIGS. 11 and 12, showing a weight support harness.
Figure 14:
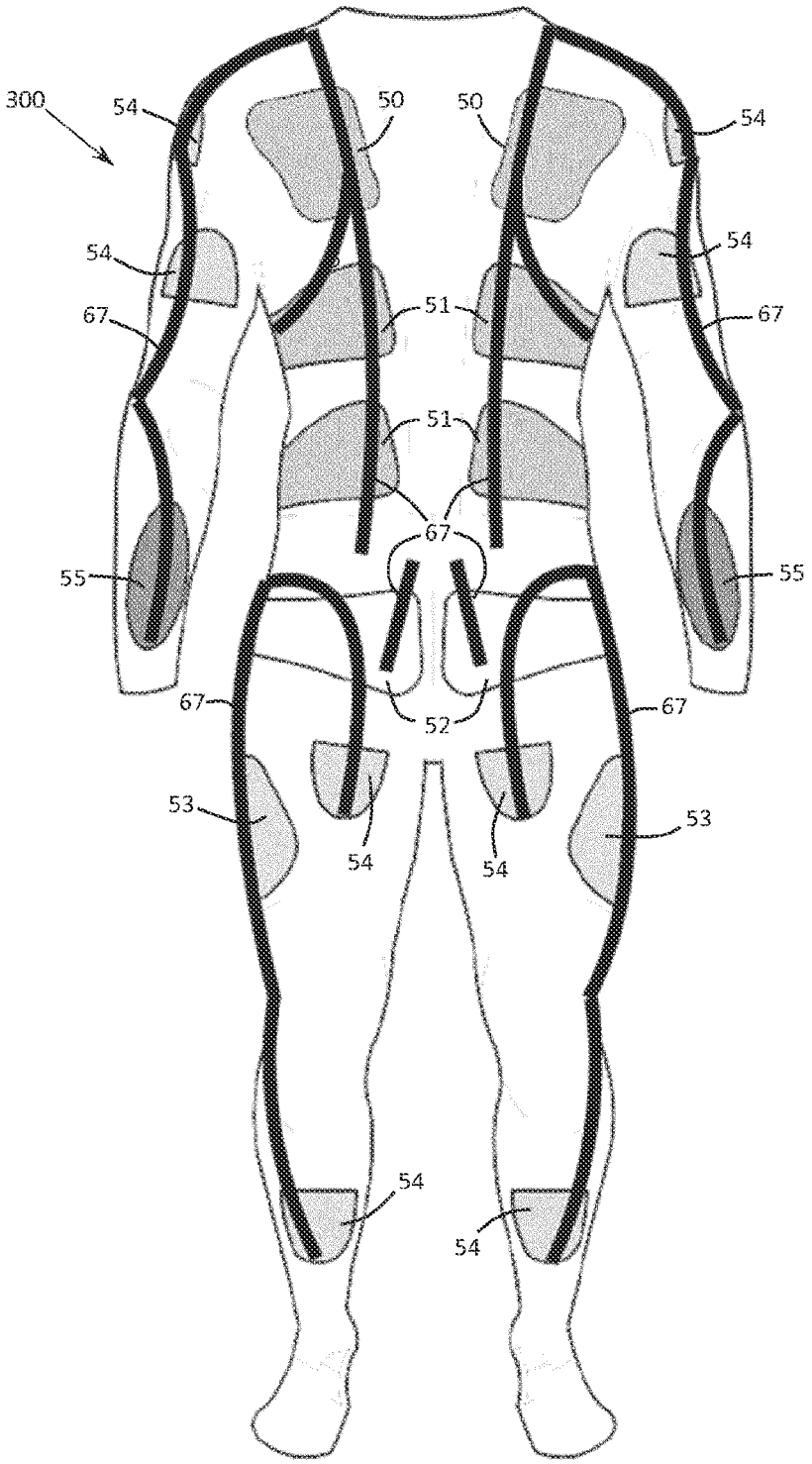
Figure 15:
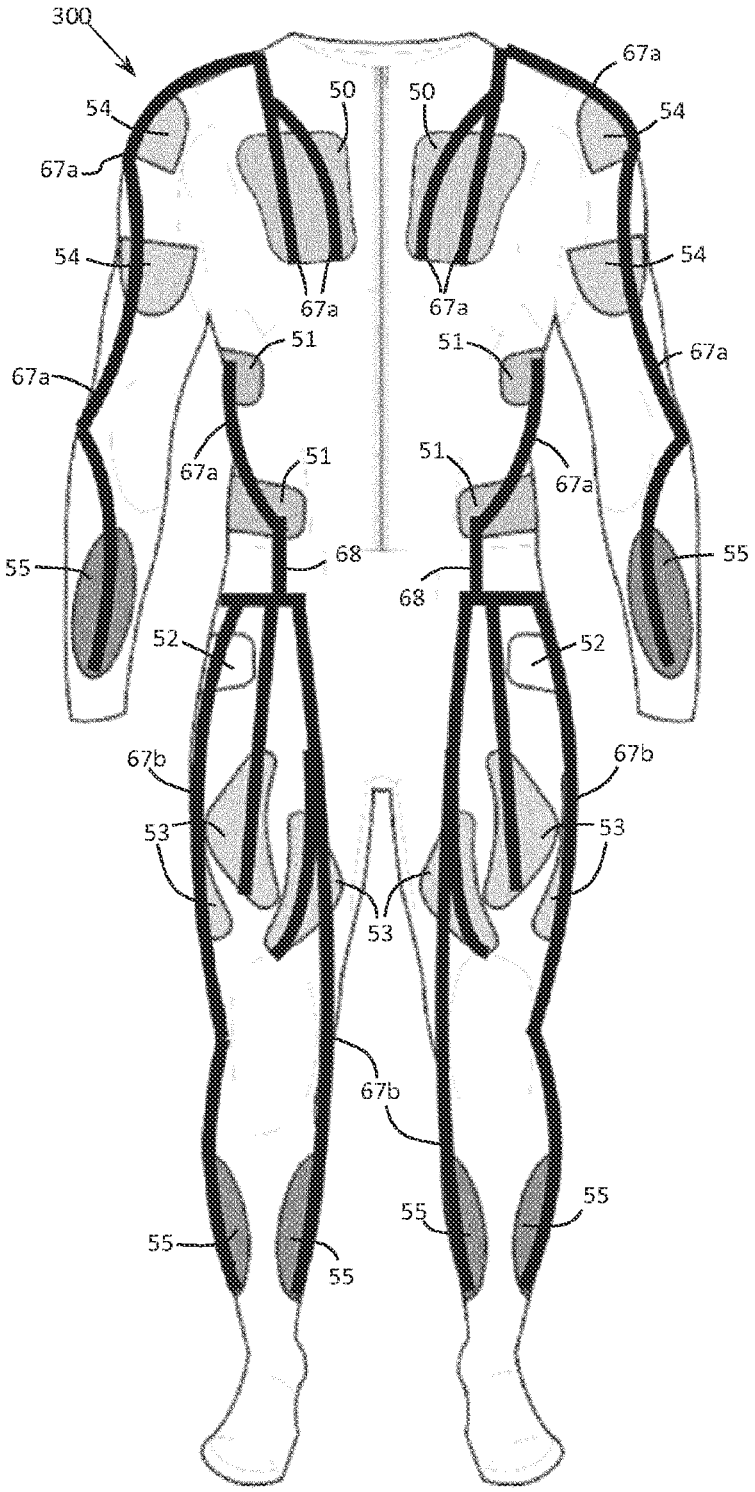
Figure 16:
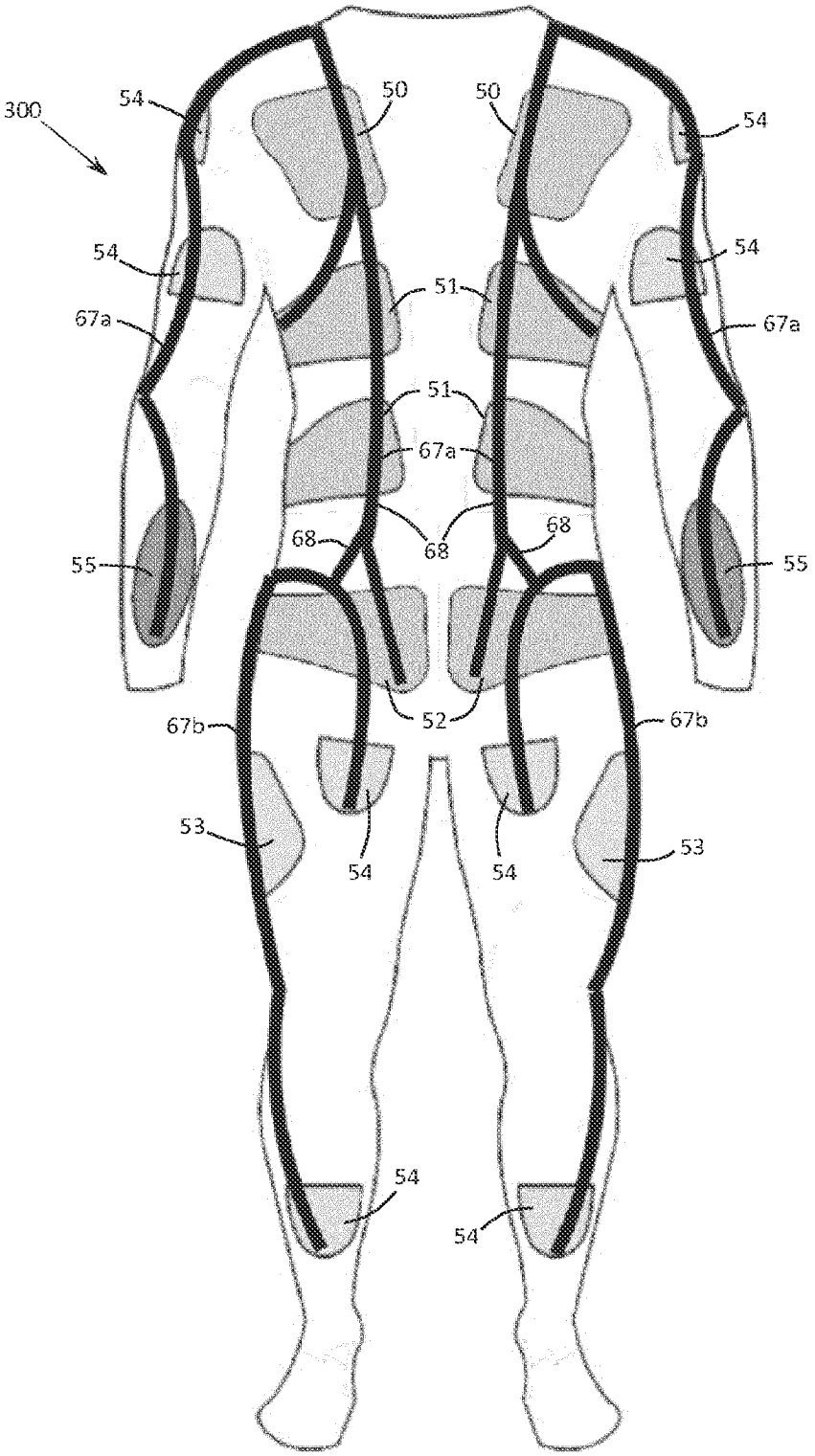
Figure 17:
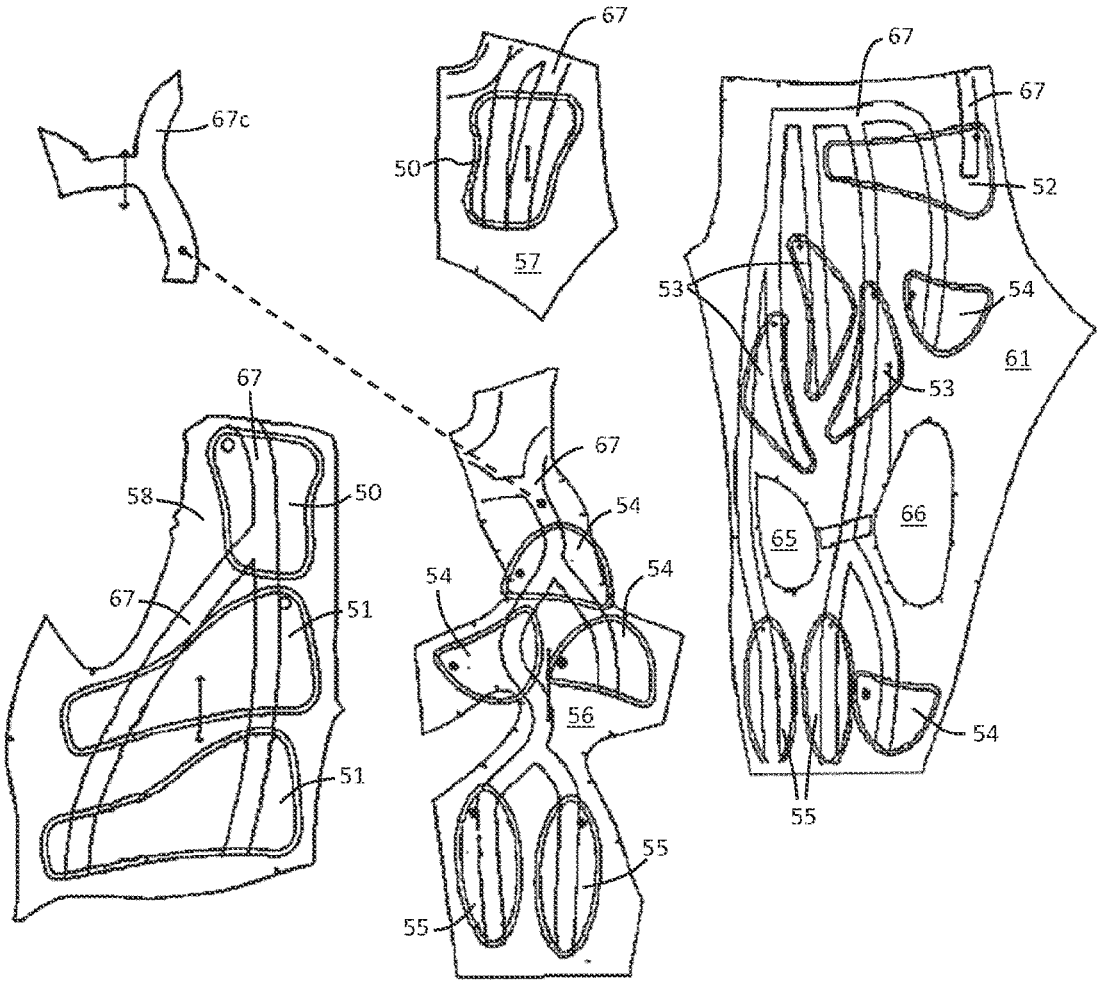

FIGS. 15 and 16 correspond to FIGS. 13 and 14 respectively, but show a modified form of the a weight support harness; and FIG. 17 shows cutting patterns for textile material used to form certain components of the base layer of the weighted garment, also indicating the positions of the support harness components and weight pockets shown in FIG. 14.

Figure 1A:
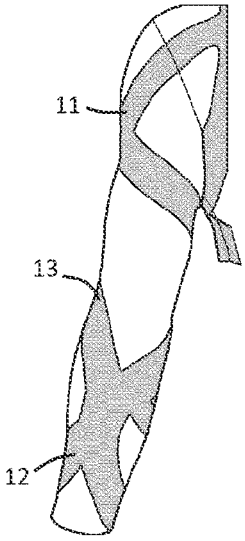
Figure 1:
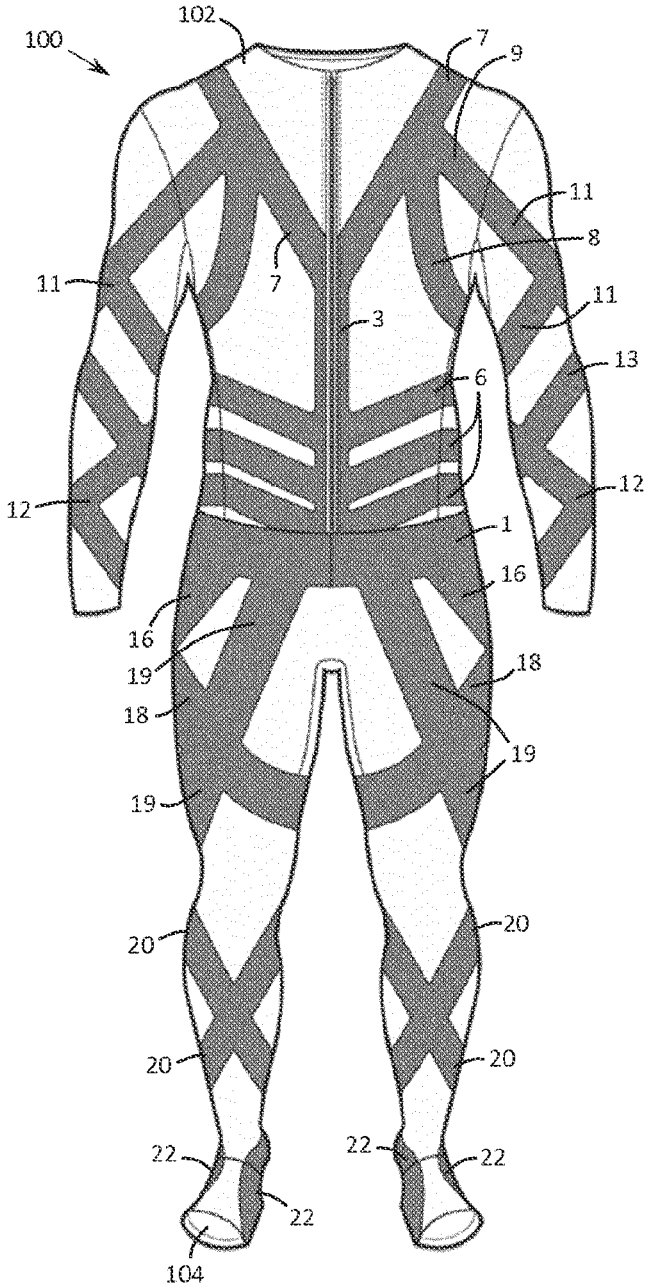
Figure 2:
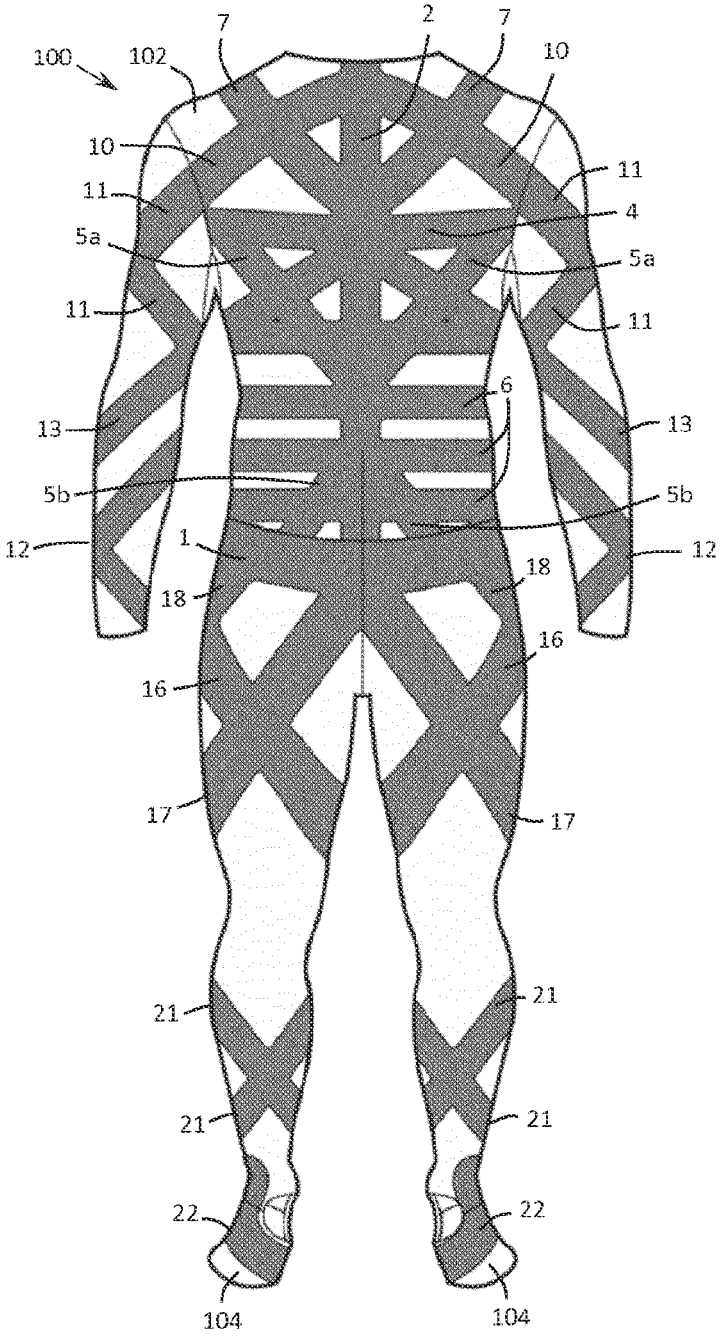
Figure 3A:
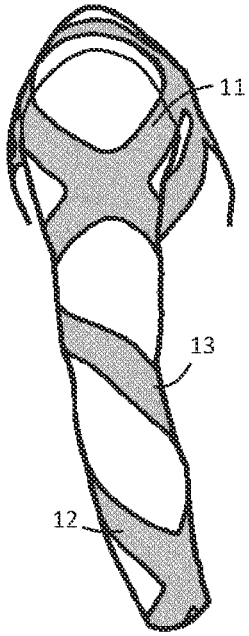
Figure 3B:
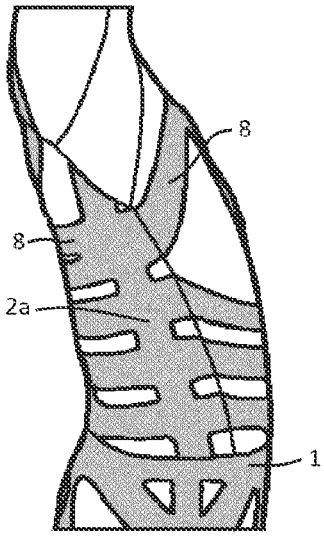
Figure 3:
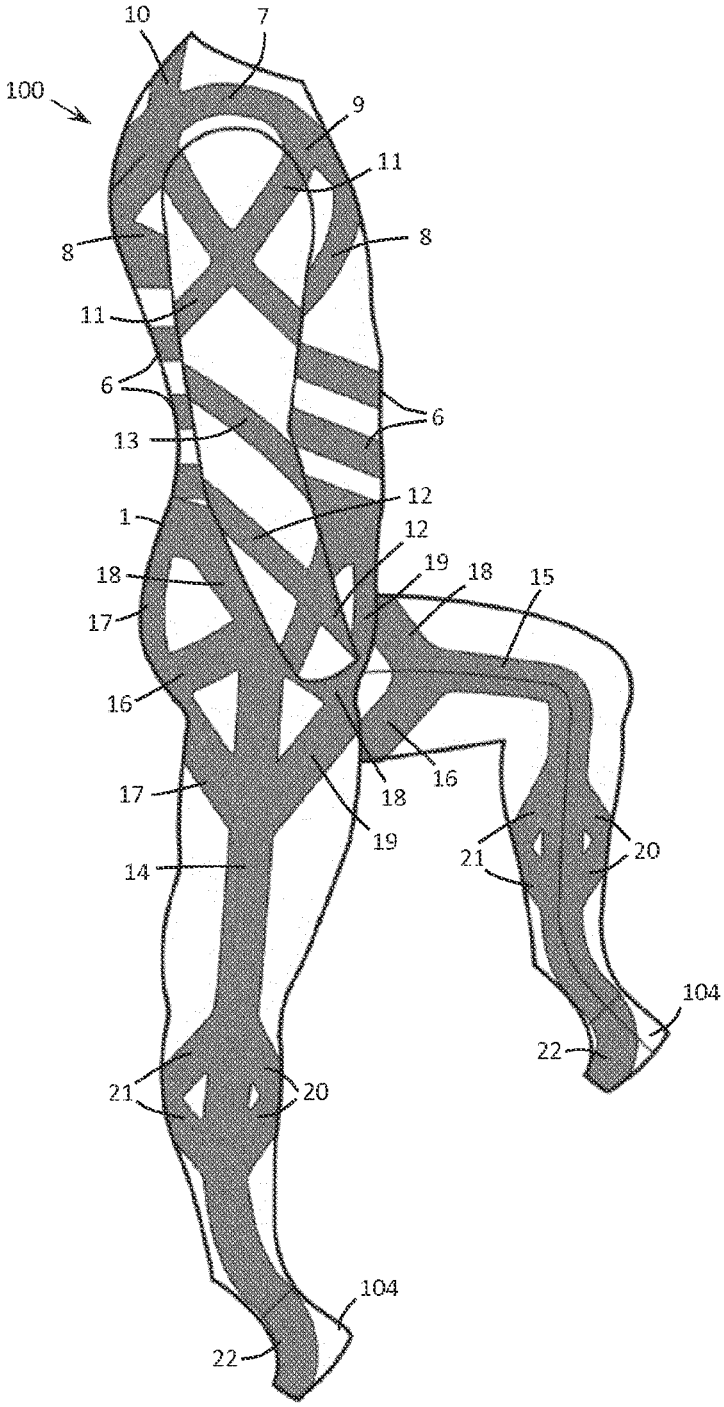

As shown in FIGS. 1-3, the posture garment 100 is in the form of a long-sleeved, one-piece body suit, with full-length legs. Base material 102 of the garment 100 comprises a suitable hard wearing, high performance, lightweight, elastically stretchable, breathable, fabric material, such as a Jersey knit synthetic textile fabric, for example Art. 120801 or Art. GGAQ fabric, both available from EUROJERSEY S.P.A., Via S. Giovanni Bosco, 260, 21042 Caronno Pertusella (Va) Italy; www.eurojersey.it.

To the outside of the garment 100, are secured elongate elastic tension elements 1-22 as described below. These are formed from an elastically stretchable fabric with the necessary mechanical properties, in particular having the required elastic stiffness in tension. A suitable material for the elongate elastic elements is GGAQ SENSITIVE® PLUS dyed Jersey knit fabric, likewise available from EUROJERSEY S.P.A. This is a textile knitted from a 73% nylon (PA)+27% elastane (EA) yarn, so as to have a weight of 117 g/m$^2$. A 5 cm×10 cm test sample subjected to a 15N axial load (e.g. according to BS14704-1:2005) extends by 125% of its original length when stretched along the course direction of the fabric; and stretches by 105% of its original length when stretched along the wale direction of the fabric. Another suitable material for the elongate elastic elements is Art. NYAL dyed Jersey knit fabric, likewise available from EUROJERSEY S.P.A. This is a textile knitted from a 59% microfibre (PA)+41% elastane (EA) yarn, so as to have a weight of 218 g/m2. A 5 cm×10 cm test sample subjected to a 15N axial load (e.g. according to BS14704-1:2005) extends by 160% of its original length when stretched along the course direction of the fabric; and stretches by 110% of its original length when stretched along the wale direction of the fabric. Assuming that the material is perfectly elastic in the course direction and is stretched in the elastic regime, applying Hooke's law, we get:

$$F=K\cdot\Delta\cdot w$$

where F is the test load, K is the material elastic constant in the course direction the force required to stretch a piece of the material 1 m wide by 100% of its original length in the course direction), Δ is the elongation (as a proportion of its original length) of the test sample under the test load, and w is the width of the test sample. Hence for the GGAQ SENSITIVE® PLUS material:

$$K=(F)/(\Delta\cdot w)$$

$$K=(15)/(1.25*0.05)=240N/m$$

for the Art. NYAL material K=187.5 N/m

Some or all of the following elongate elastic tension elements may be provided: an elastic element forming a waistband 1 of the posture garment; an elastic element 2 running from the waistband up the back of the posture garment over the wearer's spine; an elastic element 3 running from the waistband up across the wearer's abdomen and over the wearer's sternum; an elastic element forming a band 4 passing laterally across the bottom of the wearer's shoulder blades; a pair of elastic elements 5*a* sloping in diagonally opposite directions upward from the small of the user's back from element 2 to element 4; and a further pair of elastic elements 5*b* sloping in diagonally opposite directions downward from the small of the user's back from element 2 to element 1. This arrangement of elongate elastic tension elements helps the user to hold their spine erect and to control movements of their trunk. The waist band 1, posterior longitudinal tension element 2 and anterior longitudinal tension element/support 3 provide horizontal and vertical feedback to the spine and torso, to enhance upright posture and core control.

Element 3 may be divided longitudinally to allow the wearer access for putting on/taking off the posture garment. A stretchable zipper, length of hook and loop fastening, buttons, poppers or the like may run the length of element 3 for releasably fastening the two parts together.

The wearer's lower core movement guidance and feedback control may be further enhanced by additional elongate elastic tension elements interconnected over the abdominal muscles and lower spine, for example provided as: looped bands 6 running in parallel across the wearer's lower back, substantially at right angles to element 2, then around the wearer's sides, from where they slope downwardly on each side of the wearer's abdomen to meet at element 3, thereby forming substantially parallel V-shapes. For example, three or four such looped bands 4 may be provided.

For additional guidance and feedback control of the wearer's shoulder girdle, a further pair of elongate elastic tension elements 7 may slope in diagonally opposite directions, upwardly across the user's upper back, approximately from where elements 2 and 4 meet each other; then over the user's shoulders, converging downwardly so as to connect to the upper end of the anterior longitudinal tension band/support 3, forming a V-shape over the wearer's chest, A further pair of such elongate elastic tension elements 8 may slope in diagonally opposite directions, downwardly across the wearer's upper back, from approximately where elements 2 and 4 meet each other, under the armpits, and then curving upward across the wearer's chest, to meet the elements 7. In a modification shown in FIG. 3*b*, further elastic tension elements 2*a* may be provided running up and down the wearer's sides, having upper ends connecting with the elements 8 under the armpits, and having lower ends connected to the waistband elastic element 1.

Elastic tension elements for position feedback and control of the arms may be articulated and coupled with the shoulder girdle and trunk via elongate elastic tension elements 9 at the front sloping downward and outward towards the upper part of the upper arm from the elements 8; and by corresponding elongate elastic tension elements 10 at the back, sloping downward and outward from near the upper end of the posterior longitudinal tension element 2, crossing the shoulder girdle elements 7 and continuing downward and outward towards the upper part of the upper arm.

Figure 2A:
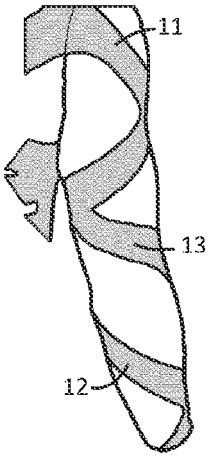

The posture garment may have sleeves comprising an elongate elastic tension element 11 looped into a gamma-shaped configuration, having its ends joined to the coupling elements 9, 10; the crossing point of the gamma lying on the outside of the upper part of the upper arm, and the loop of the gamma passing around the lower part of the upper arm. A further elongate elastic tension element 12 may be looped into a figure-of-eight configuration, with its crossing point lying on the outside of the sleeve forearm portion, its upper loop passing around an upper portion of the forearm portion, and its lower loop passing around the sleeve lower forearm portion. A further elongate elastic tension element 13 may be helically looped around the sleeve so as to interconnect elements 11 and 12. Element 13 may thus join with element 11 at the inner side of the lower portion of the upper arm, passing around the back of the arm and then across the upper part of the forearm, to join element 12 towards the inner side of the upper part of the forearm. In the modification shown in FIGS. 1*a*, 2*a* and 3*a*, the elongate elastic tension elements formerly adjacent to the elbow joint have been moved away from the elbow joint, so there are minimal forces acting directly on the area of the joint. This provides a more appropriate application, since it is not the obstruction of joints but instead the neuromuscular activation of muscles via movement through enhanced positional feedback which is sought to be increased. The modified position also avoids impinging the nerves of the forearm, which are located on the inside of the forearm. Any impingement of the nerve would reduce the neuro muscular signal. All elongate elastic tension elements are preferably engineered to avoid nerve pathways and hence avoid any potential injury or interference with neural signals.

The posture garment may have legs comprising elongate elastic tension elements coupled to elongate elastic tension elements in the pelvic or core region of the posture garment. For example the elastic elements providing enhanced feedback and positional and/or postural control of the wearer's legs relative to their trunk may comprise such an elongate elastic tension element 14 running from belt-like element 1 at the hip, down the outside of the wearer's leg, Thus the elastic elements of the trunk are connected to elastic elements in the legs of the posture garment. The posture garment may further comprise such an elongate elastic tension element 15 running down the wearer's inside leg across the knee. An elongate elastic element 16 may slope diagonally from an outer front region of the element 1, around to the back of the leg by successively crossing the wearer's hip and element 14, the wearer's lower buttock, and the inner part of the hack of the thigh, to join the upper end of element 15 on the inside leg. A further elongate elastic tension element 17 may run diagonally from a rear centre section of the element 1, across the wearer's buttock, across the element 16 and across the wearer's rear outer thigh, to join the element 14. A further elongate elastic tension element 18 may run diagonally from an outer rear section of the element 1, across the wearer's hip and the element 14, and then across the wearer's thigh, to join the upper end of element 15 and the lower end of element 16. A further elongate elastic tension element 19 may slope downwardly and outwardly from a central front section of the element 1, across the wearer's thigh and the element 18, to join element 14 near the lower end of element 17, slightly above the wearer's knee.

A pair of elongate elastic tension elements 20 may be provided sloping diagonally in opposite directions relative to the axis of the wearer's lower leg and crossing one another over the wearer' shin; and a pair of such elements 21 sloping diagonally in opposite directions relative to the axis of the wearer's lower leg and crossing one another over the wearer' calf. Both elements 20 and 21 may have a pair of ends originating at element 14 and an opposite pair of ends originating at element 15.

The legs of the posture garment 100 may be provided with stirrup-like foot portions 104 which pass beneath the arches of the wearer's feet, so as to anchor the garment legs and prevent them from riding up the wearer's legs during exercise, A stirrup-like elongate elastic tension element 22 may pass beneath the arch of the wearer's foo within garment foot portion 104, so as to interconnect the lower ends of elements 14 and 15. The stirrup-like tension elements 22 provide feedback and support to the foot arches to stimulate arch support of the foot and promote medial arch control during walking and running activities. The tension element 22 creates an upward thrust to help support the "suspension-like" mechanics of the foot arches; as opposed to foot orthotics which work from under/beneath the foot. Similar (partial) glove-like or strap-like anchoring extensions (not shown) may be provided at the bottom ends of the arms of the posture garment.

Figure 4:
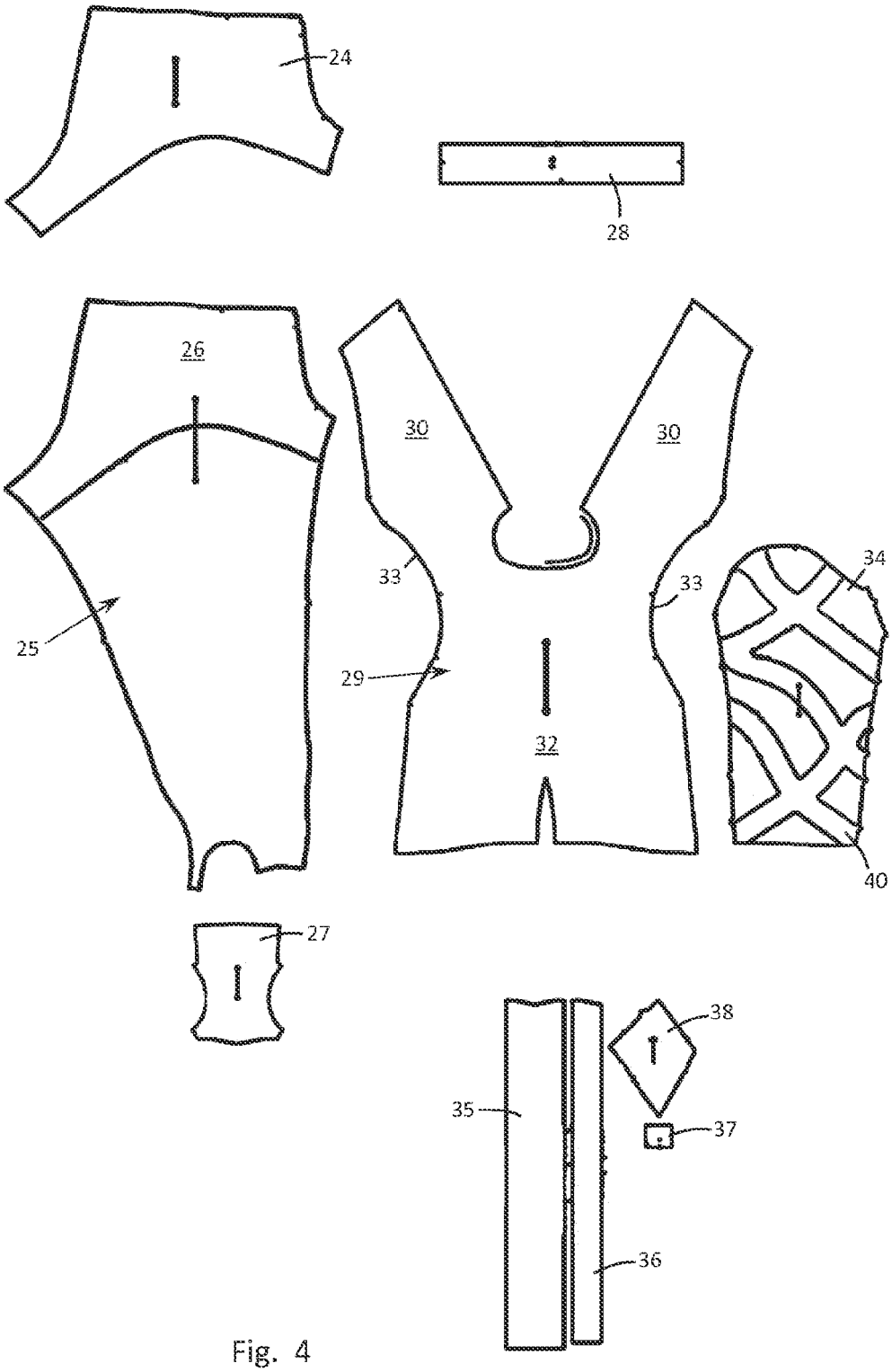
FIG. 4 shows patterns for cutting pieces of fabric to form a base layer of a second embodiment of a posture garment of the present invention.

FIG. 4 shows patterns for cutting the shapes of the various pieces of base material sewn and/or glued together to form the posture garment 100, These are identified by reference numbers as follows:

24 Waist/seat/crotch area trouser lining
25 Leg
26 Upper leg area, to which waist/seat/crotch area trouser lining is glued
27 Piece used to form stirrup part 104 at the bottom end of the garment leg
28 Collar
29 Main body of posture garment, comprising front panels 30, shoulder areas 31, back panel 32 and arm/sleeve holes 33
34 Sleeve, with pattern 40 of associated elastic tension elements shown overlaid
35 Plackets for housing the fixed zip parts
36 Pattern for glue tape for attachment of plackets to meeting edges of front panels 30
37 Garage for housing the zip runner when unzipped
38 Armhole/underarm panel insert. This may be formed from a more breathable/moisture wicking material than the remainder of the posture garment base material.

The seams between the various pieces of material may be secured by any suitable means, such as overlock stitching. A suitable stitch thread is ELOFLEX®, available from Coats Group PLC, www.coats.com; though many other suitable alternatives are available. Suitable bonding adhesive e.g. for the zip placket and trouser lining, and/or seams more generally, is seam bonding tape available from Bemis Associates UK Limited, 3-5 Turnpike Close, Grantham, U.K NG31 7XU, www.bemisworldwide.com; although again, many other suitable alternatives are available.

Figure 5:
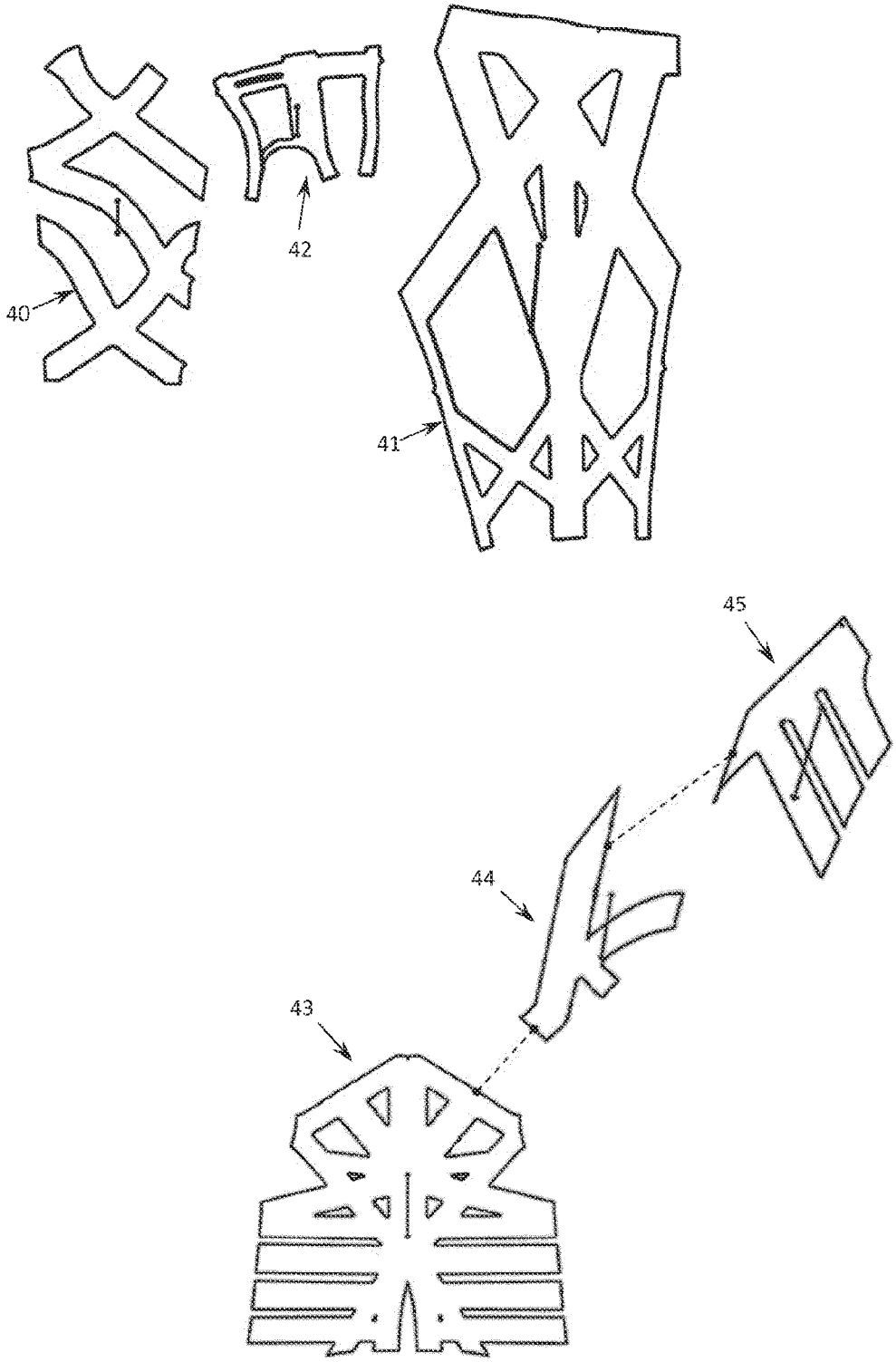
FIG. 5 shows patterns for cutting pieces of elastic fabric to form a network of elongate elastic tension members for securing to the base fabric of FIG. 5, to form the posture garment.

FIG. 5 shows patterns for cutting shapes of elastic textile material such as GGAQ SENSITIVE® PLUS or Art. NYAL which can be glued and/or sewn onto the base material to form the elongate elastic resistance elements as described above. The different shapes and their uses/positions in the assembled garment are identified reference numbers as follows:

40 Arm
41 Leg
42 Foot/stirrup portion 104 at bottom of leg
43 Back portion 32 of posture garment main body 29
44 Shoulder 31 and breast area of main body 29
45 Lower frontal 30 area of main body 29.

Figure 6:
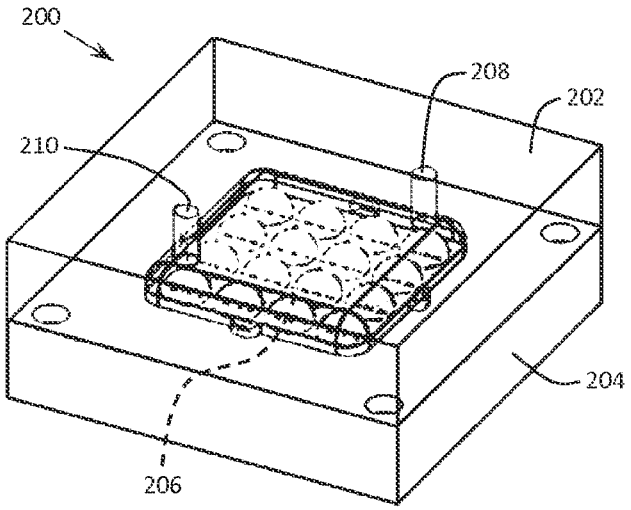
FIG. 6 shows a first mould assembly used in the first stage of casting a weight for a weighted garment according to an embodiment of the present invention.
Figure 7:
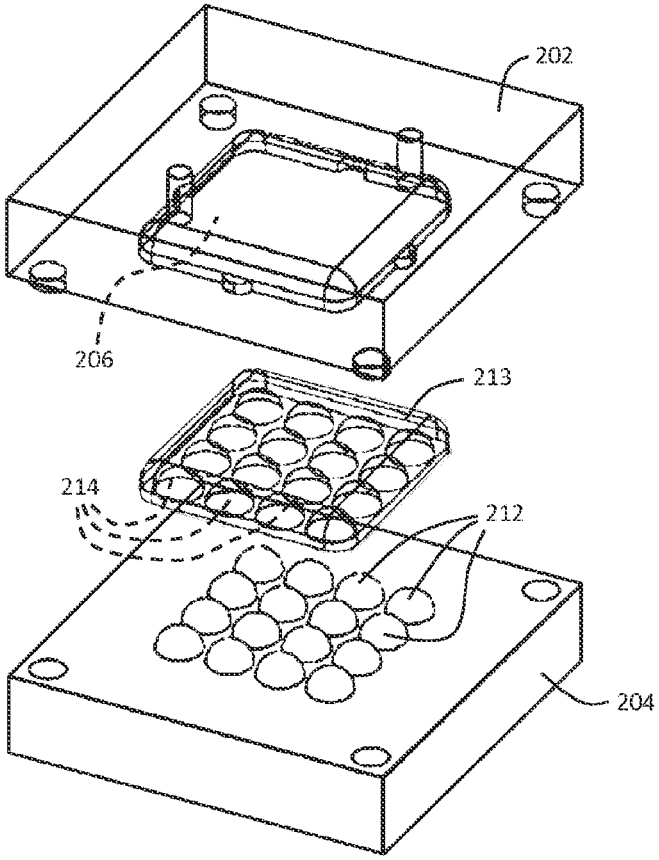
FIG. 7 shows a second stage of the casting process with mould parts separated and a cast weight half-body demoulded.

Turning now to the weights forming the second aspect of the present disclosure, FIG. 6 shows a mould tool 200 for forming a silicone rubber weight containing spheres of high density material, such as stainless steel ball bearings, or spheres of any of the other suitable high density materials mentioned above. A top mould die 202 is secured over a bottom mould die 204, thereby forming a mould cavity 206. Uncured silicone resin mixed with a suitable curing catalyst is poured or injected into the cavity through an inlet hole 208, displacing the air in the cavity through vent hole 210, until the cavity is completely filled with the silicone resin. The resin is then allowed to at least partially cure, after which the mould dies 202, 204 are separated and the silicone rubber partially-moulded weight main body or matrix component 213 is removed from the mould cavity 206, as shown in FIG. 7. Other precursor materials curable to form an elastomer may be used instead of silicone resin. The curing may take place at room temperature or at an elevated temperature as required, depending on the elastomer material concerned.

FIG. 7 also shows more clearly that the mould cavity 206 is contained in the upper mould die 202 and has the shape of half of the finished moulded weight 218. The lower mould die 204 has a generally flat upper surface. The portion of this surface which forms the base of the mould cavity 206 is provided with an array of hemispherical protrusions 212. These produce corresponding hemispherical cavities 214 in the lower surface of the partially-moulded matrix component 213. To ensure that the partially-moulded matrix component 213 has continuous outer skin that will eventually completely encapsulate the contained high density material pieces, it may be arranged that a suitable clearance exists between the tops of the protrusions 212 and the upper (inner) surface of the mould cavity 206.

Figure 8:
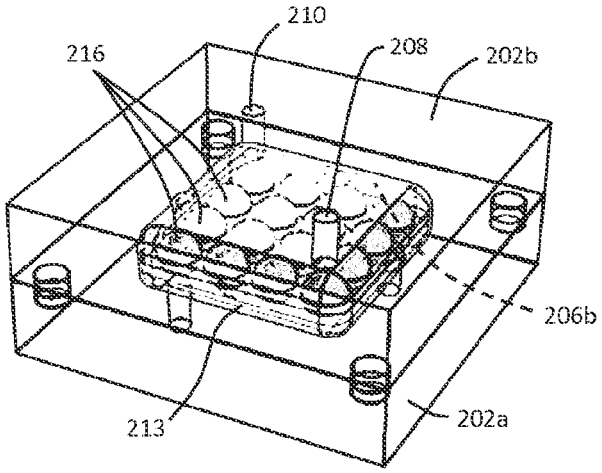
FIG. 8 shows a second mould assembly, containing the cast weight half-body and sixteen ball bearings as pieces ready to be embedded in the weight in a third moulding step.
Figure 9:
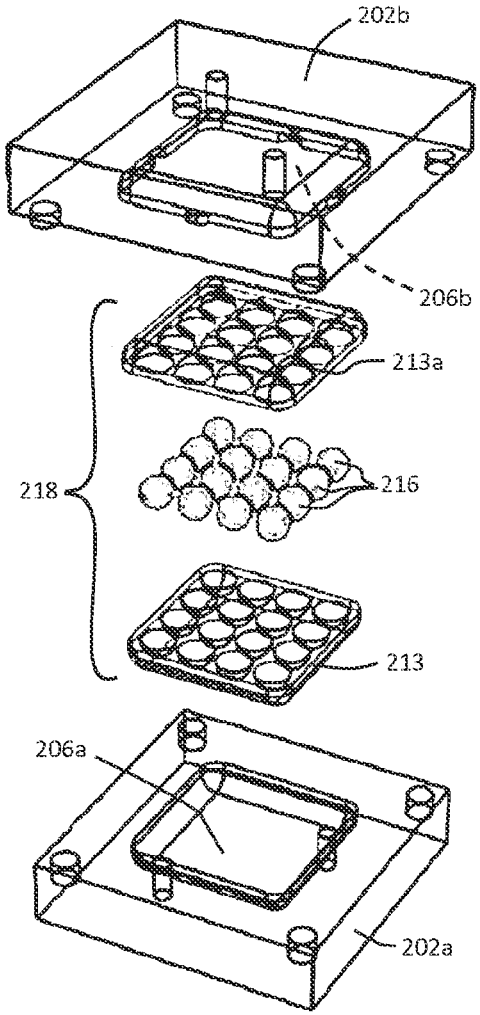
FIG. 9 shows the second mould assembly with mould parts separated after the third moulding step, the completed weight being shown in exploded view after demoulding.

As shown in FIGS. 7 and 8, the partially-moulded matrix component 213 is stripped from the mould die 204 and/or the mould cavity 206. At this stage, it may still be in a tacky state, to promote bonding with further silicone resin or other uncured elastomer precursor in the subsequent moulding steps shown in FIGS. 8 and 9. As shown in FIG. 8, the partially-moulded matrix component is then inverted, and placed in the moulding cavity of a further die 202*a*. This further die 202*a* corresponds to die 202, except that it is also inverted. The desired number of high density spheres 216 (such as 16 stainless steel ball hearings as shown) or other shaped high density pieces are then placed into the cavities in the now upper surface of partially-moulded matrix component 213. (Where non-spherical pieces are used, the shape of the protrusions 212 is adapted correspondingly). To produce finished weights of differing masses, some or all of these cavities may be selectively left unoccupied by high density pieces. A further mould die 202*b*, corresponding to mould die 202, is then secured over mould die 202*a* and catalysed silicone resin mixture (or other uncured elastomer precursor mixture) is poured or injected through inlet hole 208 of die 202*b*. The mould cavity 206*b* in die 202*b* is thereby completely filled with resin, which is allowed to cure, to completely encapsulate the spheres/pieces 216. Again a suitable clearance may be provided between the tops of the high density spheres 216 or other-shaped pieces and the upper (inner) surface of the mould cavity 206*b*; with the result that the finished moulded weight 218 has an unbroken skin and the spheres/pieces 216 are completely encapsulated in the moulded elastomer matrix. The skin may on the other hand still be made sufficiently thin to allow the harder spheres or pieces 216 to be easily felt and/or seen within the cured elastomer matrix. In other arrangements (not shown), the dies may be suitably modified so that part of the spheres or other dense pieces may be left exposed at a surface or surfaces of the finished elastomer matrix. This may for example allow the spheres/pieces to be selectively "popped" out of (and back into) the matrix or weight main body, to allow a user to adjust the mass and/or mass distribution of the weight, according to their desires. FIG. 9 shows the dies 202*a*, 202*b* separated and the resulting finished weight 218 stripped from the mould cavities 206*a*, 206*b*. To illustrate the internal structure of the weight 218, it is shown in an exploded perspective view. However, in reality in the finished weight 218, the matrix or main body components 213, 213*a* will be bonded together at their meeting zone, so as to surround and contain the dense spheres or pieces 216.

Figure 10:
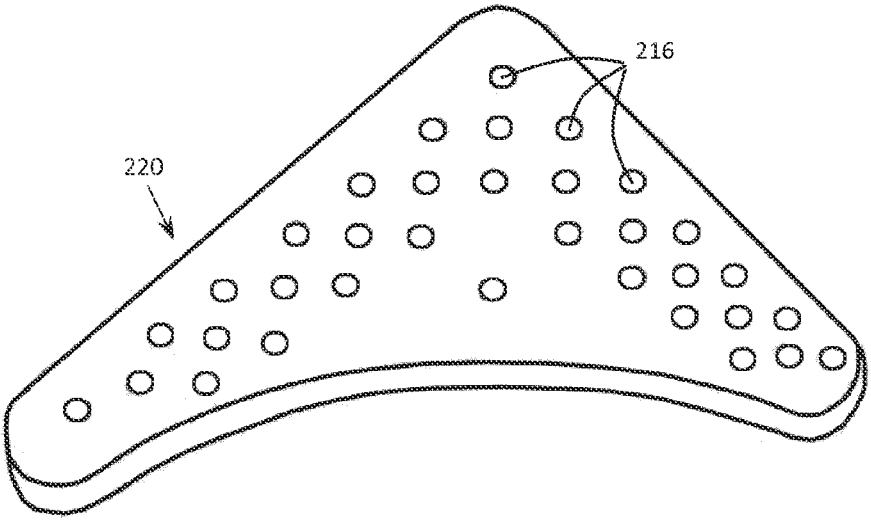
FIG. 10 shows a finished, chevron-shaped weight for a weighted garment according to the present invention.

The above described moulding tools and process may be readily adapted to produce weights containing more than a single layer of dense pieces 216. For example, mould cavity 206*b* in die 202*b* may be suitably deepened and its inner (upper) surface provided with an array of protrusions shaped to form cavities in matrix component 213*a*, for reception of a further (full or partial) layer of dense pieces 216. One or more further matrix component layers thus may then be moulded on top of matrix component 213*a*. Other suitable elastomeric matrix materials may be used, for example TPE. Other known manufacturing processes may be used e.g. to automate and scale up production when required; e.g. by using more automated insert injection molding tools and equipment, e.g. with robotic placement (or other suitable automatic feeding/placement) of the dense pieces. Although a generally square weight is shown in FIGS. 6-9, with rounded edges and corners for additional comfort when worn next to the body, the moulding process can be adapted to produce weights in a wide variety of other shapes, with or without rounded edges and corners. The arrangement of the high density pieces within the elastomer matrix may also be varied from the rows and columns at right angles as shown; e.g. to a close packed hexagonal arrangement, or a more random arrangement, or an arrangement adapted to suit the shape of a particular weight. Weights which are generally flat in the relaxed state but which are sufficiently thin and flexible will mould themselves to the wearer's body in use. By virtue of their low profile they are also less likely to interfere with the user's movements, e.g. during sports training, physiotherapy, exercise, or daily use. A low profile may also be more attractive as regards the aesthetics of the exercise garment within which the weights are incorporated, FIG. 10 shows by way of example a low-profile, flat, generally chevron-shaped weight 220, with a mixture of straight and curved sides, rounded corners and square edges. The weight 220 contains an uneven distribution of embedded dense pieces 216, generally in a single layer, close-packed hexagonal arrangement. These are visible through the main body or matrix of the weight, which is transparent or translucent. The shape of the weight in plan may be adapted to imitate the anatomy (e.g. muscle structure) that it overlies in use. Additionally or alternatively it may be shaped for minimal interference with the wearer's limb and body movements, and/or with the operation of associated sports or orthopaedic clothing, footwear, headgear, equipment, prostheses, tools, backpacks, vehicles, furniture or the like used by the wearer.

Figure 11:
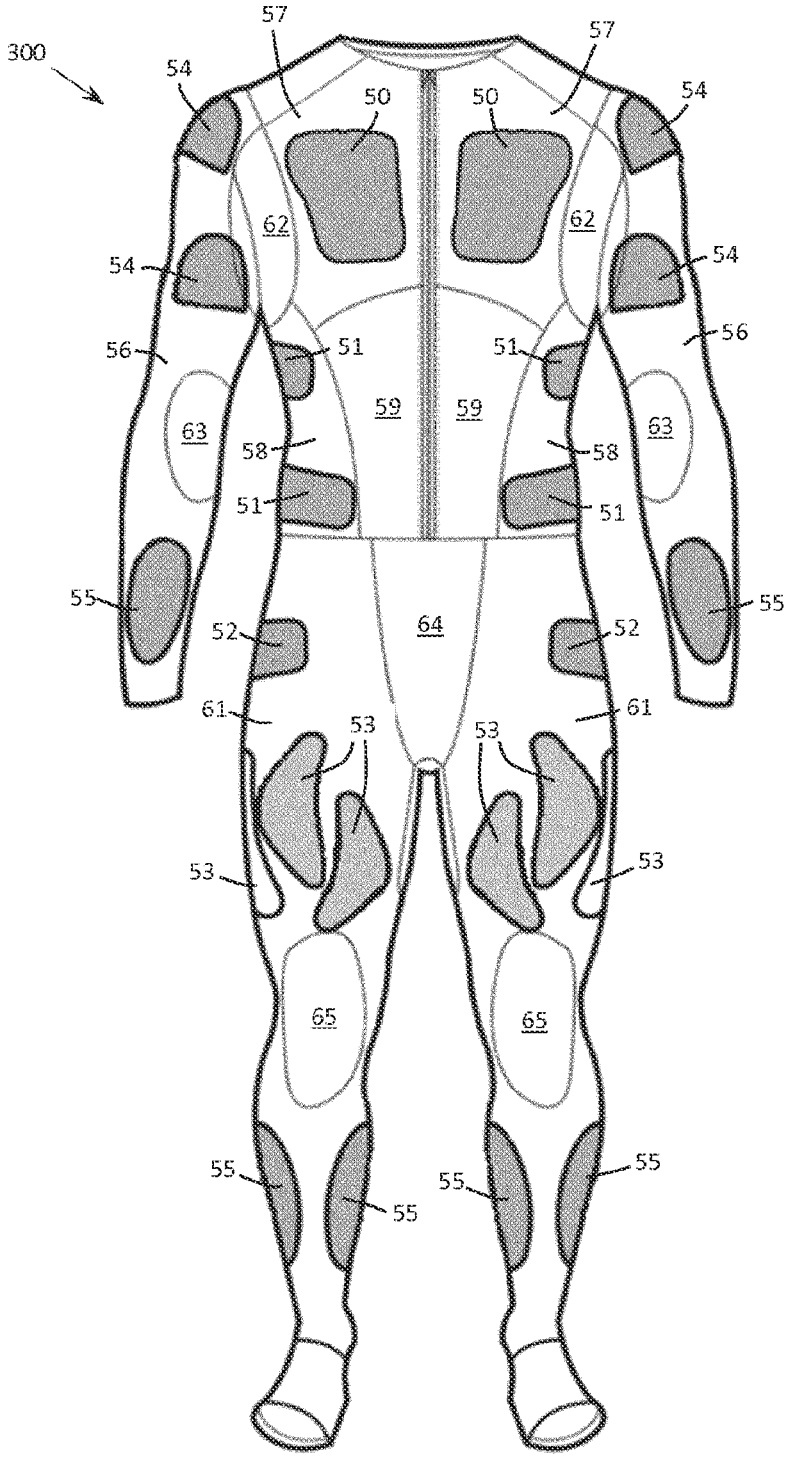
FIG. 11 is a diagrammatic front view of a first embodiment of a weighted garment of the present invention, showing the positions of weights.
Figure 12:
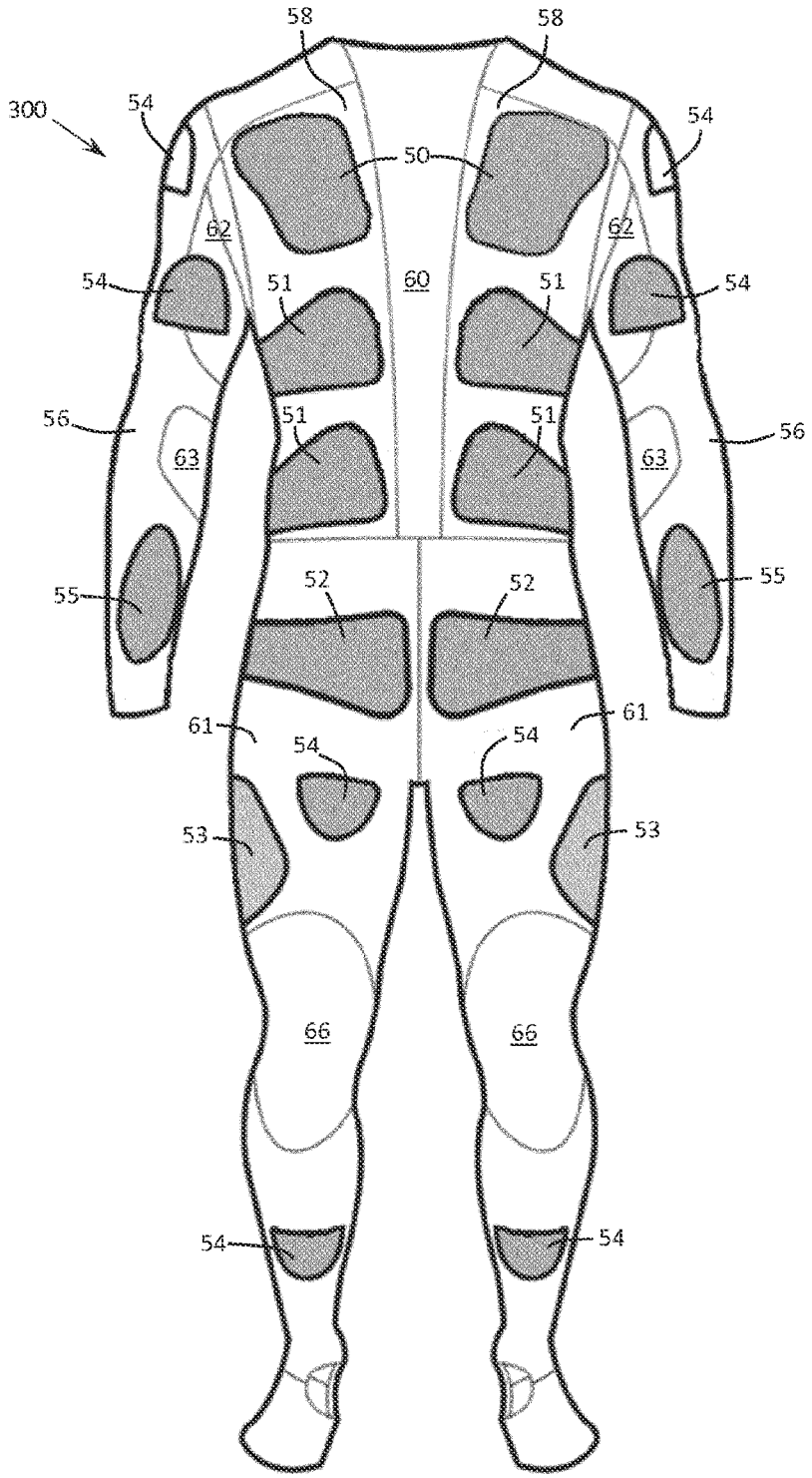
FIG. 12 is a back view of the weighted garment of FIG. 11.

FIGS. 11 and 12 show a weighed garment 300 which may be used on its own to exercise and strengthen the hones and joints and to tone and strengthen the major muscles and connective tissues of the human body. The garment 300 may also be used together with the posture garment 100 described above (e.g. worn over the posture garment 100) for enhanced movement guidance and feedback during such strengthening exercises and training. The weighted garment 300 comprises a number of low profile external pockets 50-55, for reception of weights which may be formed and constructed as described above with reference to FIGS. 6-10. The pockets may be formed from the same material as the base material used to construct the majority of the weighted garment 300. This material is preferably a hard wearing, high performance, lightweight, elastically stretchable, breathable, fabric material, such as a synthetic textile fabric, for example NYAL SENSITIVE® SCULPT fabric, which is a highly stretchable warp knitted fabric of 218 g/m$^2$ nominal weight, made from 59% PA+41% EA yarn, and available from EUROJERSEY S.P.A. The pockets 50-55 may be attached to the base fabric by zip-zag stitching in ELOFLEX® thread (which may also be used to secure other seams in the weighted garment 300). The pockets 50-55 may incorporate zip fasteners along sufficient of their peripheral edges to allow the weights to be easily inserted and removed. Alternatively, any other suitable form of openable and closable fastening may be used in place of such zip fasteners, for example rows of (e.g. 4 or 5) press studs or buttons/button holes, or hook-and loop fastenings. The fastenings should be securable so as to allow the weights to be compressed within the pockets. The pockets are sized to be a tight fit around the weights when closed, so that the adjacent garment base material and pocket material is slightly stretched. This, together with the low profile, generally flat shape of the weights and the fact that their exposed surface is of silicone rubber, or a similar elastomer having a relatively high friction coefficient in co-operation with the base/pocket material, means that the weights are firmly held and do not move about in the pockets even when the wearer of the weighted garment is performing activities and exercises involving high accelerations. Similarly, the weighted garment 300 is sized to be a close, body-hugging fit on the wearer, whereby the arms, legs, buttocks and trunk region of the garment 300 are circumferentially stretched. This helps to hold the weights permanently against the wearer's skin and frictionally holds them against shifting circumferentially on the wearer's body and limbs, even during vigorous accelerations.

The weighted garment is constructed from a number of base panels secured together by overlooked internal seams:

| | |
|---|---|
| 56 | Arm and shoulder panel (left + right) |
| 57 | Breast panel (left + right) |
| 58 | Back and side panel (left + right) |
| 59 | Abdominal panel (left + right) |
| 60 | Centre back panel |
| 61 | Leg, waist and buttock panel (left + right). |

A zip or other suitable fastener or set of fasteners may be provided at the meeting edges of the left and right breast and abdominal panels 57, 59. The upper part of the garment may thereby be opened up to allow the user to put on or take off the weighted garment 300.

Certain parts of the weighted garment 300 subjected to high strains in use may be made from an even more breathable and elastic material, for improved performance.

A suitable material for these parts is for example product article 6345 POWER-NET supplied by Piave Maitex S.R.L, of Via Torino, 125, 21042 Caronno Pertusella (VA), Italy www.piavemaitex.com. This material has a nominal weight of 125 g/m$^2$ and is warp knitted from PA 88%+EA 12% yarn. In the example shown in FIGS. 11 and 12 these parts are:

| | |
|---|---|
| 62 | Armpits |
| 63 | Elbow crooks |
| 64 | Crotch |
| 65 | Knees |
| 66 | Hams. |

For ease of manufacture, and to enable simplified user selection and substitution of weights of different masses for use at a particular location in the weighted garment 300, although the weighted garment has quite a large number of weight pockets and corresponding weights (34 as shown in FIGS. 11 and 12 for example), these are made up of a smaller number of differently shaped weights/pockets:

Shape 50 used on the chest and shoulder blades (4 off, each containing for example 370 g of high density material, for example 81 stainless steel ball bearings of 9.5 mm diameter);

Shape 51 used on the upper and lower torso, mainly at the rear, but also extending around the sides to approach the lower chest and abdomen (4 off, each containing for example 660 g of high density material, for example 186 stainless steel ball bearings);

Shape 52 used on the buttocks, but also extending forwardly around the hips, towards the groin (2 off, each containing for example 570 g of high density material, for example 123 stainless steel ball bearings);

Shape 53 used around the front and sides of the thighs (6 off, each containing 326 g of high density material, for example 92 stainless steel ball bearings);

Shape 54 used on the deltoids, upper arms, backs of the thighs and calves (10 off, each containing 222 g of high density material, for example 48 stainless steel ball bearings)

Shape 55 used on the forearms and lower legs (8 off, each containing 275 g of high density material, for example 60 stainless steel ball bearings).

Other suitable combinations of weights are also possible, with correspondingly shaped weight pockets being provided in the garment at the required locations accordingly.

For example:

Shape 50 used on the chest and shoulder blades as shown in FIGS. 11 and 12 (4 off);

Shape 52 used in place of shape 51 in the positions shown on the upper and lower torso, as well on the buttocks and hips (6 off);

Shape 55 used in place of shape 53 around the front and sides of the thighs (6 off);

Shape 54 used on the deltoids, upper arms, backs of the thighs and calves as above, but also used in place of shape 55 on the forearms and lower legs (16 off).

As shown in FIGS. 13 and 14, the weighted garment also comprises strips or ribbons 67 of relatively inextensible fabric material, sewn or glued onto the base material. These strips or ribbons form a network interconnecting the base material within the pockets 50-55, and hence serving to distribute loads from the weights into the base material. This helps to ensure that the weights do not sag under gravity or move outwards from a centre of rotation under centrifugal force; thereby helping to ensure that the weights remain in a fixed axial position on the wearer's limbs and trunk in use of the garment, even during vigorous exercise or training. It will be seen that the strips 67 for the most part run generally longitudinally of the wearer's limbs and torso and form a branched network with bases mainly originating at the shoulders and hips. A proportion of the weight loads are thereby transmitted to and carried by the wearer's shoulder girdle and pelvis. It can also be seen that the network of relatively inextensible strips 67 does not completely encircle the wearer's limbs and torso. The weighted garment 300 therefore remains free to stretch and contract circumferentially with the movement, expansion and contraction of the wearer's body, limbs and muscles. The garment therefore is not inhibitive to movement and feels free and comfortable to wear. To avoid restriction of shoulder movement and uncomfortable overloading of the shoulders, a portion of the network in this region (e.g. between the arrows in FIG. 13) may be made from a more elastic material than the remainder of the network, but still less elastic than the base material of the weighted garment 300. The majority of the strips or ribbons 67 may be made from Art. 10252 material, available from EUROJERSEY S.P.A., or any other suitable relatively inextensible textile or other material.

In FIGS. 13 and 14 there are separate networks of the relatively inextensible strips or ribbons 67 (*i*) in the legs (transmitting weight forces to the pelvis), and (ii) in the remainder of the garment (transmitting weight forces to the shoulder girdle). The garment may therefore be made either in one piece as shown; or as a two piece set consisting of a separate jacket and trousers. The panels 58, 59 and 60 forming the hem of the separate jacket may be extended downwardly beyond the limit shown in FIGS. 11 and 12, so as to overlap the waistband of the trousers. In the variant one-piece weighted garment 310 shown in FIGS. 15 and 16, upper inextensible network strips 67*a* are interconnected with lower inextensible network strips 67*b* via linking inextensible strips 68. This provides additional support for the lower body and leg weights.

FIG. 17 shows patterns which can be used to cut the panels 56, 57, 58 and 61 of weighted garment 300 to shape; also showing the shapes and placement positions for their associated weight pockets and inextensible strips 67. Strip element 67*c* may be made from the slightly more elastic material, as discussed above with respect to the arrowed portion of FIG. 13.

The disclosed posture garments and weighted garments therefore fulfil separate but complementary functions. The posture garment provides enhanced tactile and kinaesthetic feedback for dynamic guidance of the wearer's posture and limb and body movements; with little or no significant resistance to such movements. The weighted garment provides physical resistance for strengthening and toning the wearer's musculoskeletal system or selected parts of it. The garments may be used separately, but when used together, the posture garment can provide position and motion feedback and guidance which enhances and optimises the benefits of the weighted suit, by helping the resistance exercises to be performed with the correct movement patterns and postures, thereby enhancing their beneficial effects and minimising risk of injury. Together with some initial training, the posture garment acts as a pseudo personal trainer or coach, helping the weighted garment to be used to best effect. The posture garment may be used without the weighted garment for feedback and guidance of physical exercises, sports techniques and physiotherapy not requiring additional equipment, or guiding such activities which use other equipment, such as training weights, golf clubs, cricket bats, tennis racquets, medicine balls, running and exercise machines, ruck-and-maul machines, etc. For an experienced user or where a human coach/trainer is available, or in the absence of better options, the weighted suit may be used on its own for toning and strengthening the musculoskeletal system.

The invention claimed is:

1. Posture and movement training apparel comprising:

i) a posture and movement training garment, including at least one elastic element, wherein the at least one elastic element is arranged to be stretched upon a movement of one of a wearer's trunk, at least one of the wearer's limbs, or both the wearer's trunk and at least one of the wearer's limbs away from a predetermined rest or neutral position, wherein the at least one elastic element is configured to provide the wearer with additional kinaesthetic feedback, touch feedback, or both kinaesthetic and touch feedback resulting from the movement, without substantially inhibiting the movement;

wherein the posture and movement training apparel further comprises:

ii) a weighted garment worn over the posture and movement training garment to exercise and strengthen bones and joints and to tone and strengthen major muscles and connective tissues of the wearer's body; the posture and movement training garment providing enhanced movement guidance and feedback during such strengthening and training; and the weighted garment comprising a plurality of low profile external pockets in which weights are received, wherein shapes of the weights in a plan view are adapted to imitate muscle structures that the weights overlie in use, and wherein the plurality of pockets and weights comprise sets of differently shaped weights/pockets, the sets comprising:

a set of four of a first shape extending along a chest and shoulder blades of the wearer when the apparel is worn; and a set of six of a second shape:

two of which extend along on an upper torso of the wearer when the apparel is worn, so as to extend along a rear portion of the upper torso and extend along sides of the wearer to approach a lower chest of the wearer when the apparel is worn;

two of which extend along a lower torso of the wearer when the apparel is worn, so as to extend along a rear portion of the lower torso and extend along sides of the wearer to approach an abdomen of the wearer when the apparel is worn; and two of which extend along buttocks of the wearer when the apparel is worn, and further extend forwardly around hips of the wearer towards a groin of the wearer, when the apparel is worn.

2. The posture and movement training apparel of claim 1, wherein the at least one elastic element comprises a textile material comprising a material elastic constant in a direction of stretch of about 190 N/m.

3. The posture and movement training apparel of claim 1, wherein the at least one elastic element comprises an elongate length of textile material attached to a base layer of the posture and movement training garment.

4. The posture and movement training apparel of claim 1, wherein the at least one elastic element comprises a plurality of elastic elements each comprising a textile material comprising a different material elastic constant, a different length, or both a different material elastic constant and a different length.

5. The posture and movement training apparel of claim 1, wherein the at least one elastic element comprises a plurality of elastic elements each comprising a textile material comprising one of a different width, a different length, a different number of layers, or any combination thereof.

6. The posture and movement training apparel of claim 1, in which a stress-strain behaviour of at least one of the at least one elastic element is one of non-linear, rate dependent, or both non-linear and rate dependent.

7. The posture and movement training apparel of claim 1, in which a recoil of the at least one elastic element provides the wearer with enhanced guidance for relative movement of different portions of the trunk or torso.

8. The posture and movement training apparel of claim 7, in which the different portions of the trunk or torso comprise at least two of: a shoulder girdle, thorax, abdomen, spine, core, pelvic girdle/sacrum, sternum, mid-back, and mid-point between an anterior pelvic ridge and an umbilicus.

9. The posture and movement training apparel of claim 1, in which a recoil of the at least one elastic element provides the wearer with enhanced guidance of movement of one of:

a head, limbs, or head and limbs relative to the trunk;

between different portions of the limbs; or a head, limbs, or head and limbs relative to the trunk and between different portions of the limbs.

10. The posture and movement training apparel of claim 9, in which the recoil of the at least one elastic element provides the wearer with enhanced guidance of relative movement of:

a shoulder girdle and a point along a length of a humerus;

between a point along the humerus and a point along a forearm;

between a pelvic girdle and a point along a thigh bone;

between a point along a thigh bone and a point along a shin; or any combination thereof.

11. The posture and movement training apparel of claim 1, in which the additional kinaesthetic feedback, touch feedback, or both kinaesthetic and touch feedback is provided for one, two, or three orthogonal planes of rotation or one, two, or three degrees of rotational freedom of the movement.

12. The posture and movement training apparel of claim 1, in which enhanced movement feedback and guidance for core muscles and joints is provided to the wearer by the at least one elastic element arranged in the posture and movement training garment over the wearer's abdominal muscles and posterior spine.

13. The posture and movement training apparel of claim 1, wherein the at least one elastic element comprises a plurality of elastic elements, wherein one elastic element of the plurality of elastic elements is associated with the wearer's trunk and is connected to another elastic element of the plurality of elastic elements providing enhanced guidance of the wearer's limbs.

14. The posture and movement training apparel of claim 1, in which the posture and movement training garment comprises a leg provided with an attached foot part arranged for passing beneath an arch of the wearer's foot.

15. The posture and movement training apparel of claim 1, wherein the at least one elastic element comprises a plurality of elastic elements, in which fabric pieces cut to a pattern form a plurality of different fabric pieces where each fabric piece contains at least parts of different elastic elements of the plurality of elastic elements, so that one or more or all of the elastic elements are assembled from the plurality of different fabric pieces.

16. The posture and movement training apparel of claim 1, wherein the sets of differently shaped weights/pockets further comprise a set of a third shape extending around a front and sides of thighs of the wearer when the apparel is worn, and a set of a fourth shape extending along deltoids, upper arms, backs of thighs, calves, and lower legs of the wearer when the apparel is worn.

17. A weighted garment comprising a plurality of low profile external pockets in which weights are received, wherein shapes of the weights when viewed in a plan view are adapted to imitate muscle structures of a wearer that the weights overlie when the garment is worn, and wherein the plurality of pockets and weights comprise sets of differently shaped weights/pockets comprising:

a set of four of a first shape extending along a chest and shoulder blades of the wearer when the weighted garment is worn, and a set of six of a second shape:

two of which extend along an upper torso of the wearer when the weighted garment is worn, so as to extend along a rear portion of the upper torso and extend along sides of the wearer to approach a lower chest of the wearer when the weighted garment is worn;

two of which extend along a torso of the wearer when the weighted garment is worn, so as to extend along a rear portion of the lower torso and extend along sides of the wearer to approach an abdomen of the wearer when the weighted garment is worn; and two of which extend along buttocks of the wearer when the weighted garment is worn, and further extend forwardly around hips of the wearer, towards a groin of the wearer, when the weighted garment is worn.

18. The weighted garment of claim 17, wherein the sets of differently shaped weights/pockets further comprise a set of a third shape extending around a front and sides of thighs of the wearer when the weighted garment is worn, and a set of a fourth shape extending along deltoids, upper arms, backs of thighs, calves, and lower legs of the wearer when the weighted garment is worn.

19. Posture and movement training apparel comprising:

a posture and movement training garment, including at least one elastic element; and a weighted garment worn over the posture and movement training garment, the weighted garment comprising a plurality of low profile external pockets in which weights are received, wherein shapes of the weights are adapted to imitate muscle structures that the weights overlie in use and wherein the plurality of pockets and weights comprise sets of differently shaped weights/pockets, the sets comprising:

a set of four of a first shape extending along a chest and shoulder blades of the wearer when the apparel is worn; and a set of six of a second shape:

two of which extend along on an upper torso of the wearer when the apparel is worn, so as to extend along a rear portion of the upper torso and extend along sides of the wearer to approach a lower chest of the wearer when the apparel is worn;

two of which extend along a lower torso of the wearer when the apparel is worn, so as to extend along a rear portion of the lower torso and extend along sides of the wearer to approach an abdomen of the wearer when the apparel is worn; and two of which extend along buttocks of the wearer when the apparel is worn, and further extend forwardly around hips of the wearer towards a groin of the wearer, when the apparel is worn.

20. The posture and movement training apparel of claim 19, wherein the sets of differently shaped weights/pockets further comprise a set of a third shape extending around a front and sides of thighs of the wearer when the apparel is worn, and a set of a fourth shape extending along deltoids, upper arms, backs of thighs, calves, and lower legs of the wearer when the apparel is worn.

* * * * *